US008045892B2

(12) United States Patent
Sakata et al.

(10) Patent No.: US 8,045,892 B2
(45) Date of Patent: Oct. 25, 2011

(54) DEVELOPING UNIT, PROCESS CARTRIDGE, AND IMAGE FORMING METHOD AND APPARATUS INCORPORATING AN AGITATION COMPARTMENT

(75) Inventors: Koichi Sakata, Shizuoka-ken (JP); Satoru Yoshida, Zama (JP)

(73) Assignee: Ricoh Company Limited, Tokyo (JP)

( * ) Notice: Subject to any disclaimer, the term of this patent is extended or adjusted under 35 U.S.C. 154(b) by 772 days.

(21) Appl. No.: 12/110,055

(22) Filed: Apr. 25, 2008

(65) Prior Publication Data

US 2008/0267668 A1 Oct. 30, 2008

(30) Foreign Application Priority Data

Apr. 27, 2007 (JP) ..... 2007-118351
Oct. 22, 2007 (JP) ..... 2007-274206

(51) Int. Cl.
*G03G 15/08* (2006.01)
*G03G 15/09* (2006.01)

(52) U.S. Cl. ..... 399/254; 399/272; 399/277

(58) Field of Classification Search ..... 399/254–256, 399/272, 273, 277
See application file for complete search history.

(56) References Cited

U.S. PATENT DOCUMENTS 6,259,876 B1 * 7/2001 Fukuda et al. ..... 399/254
6,308,035 B1 * 10/2001 Fukuda ..... 399/254
7,169,525 B2 1/2007 Sugiura et al.
7,258,959 B2 8/2007 Nakayama et al.
7,261,989 B2 8/2007 Sugiura et al.
7,318,989 B2 1/2008 Kotsugai et al.
7,466,944 B2 * 12/2008 Bessho ..... 399/254
7,729,641 B2 * 6/2010 Suzuki ..... 399/254
2005/0208411 A1 9/2005 Nakayama et al.
2006/0029433 A1 2/2006 Saito et al.
2006/0063081 A1 3/2006 Nagatomo et al.
2006/0204883 A1 9/2006 Nakayama et al.
2007/0160392 A1 7/2007 Tsuda et al.
2007/0190444 A1 8/2007 Kotsugai et al.
2007/0264052 A1 11/2007 Yoshida et al.
2007/0264054 A1 11/2007 Tsuda et al.
2007/0275318 A1 11/2007 Sugiura et al.

(Continued)

FOREIGN PATENT DOCUMENTS

JP 9-146355 6/1997

(Continued)

OTHER PUBLICATIONS

U.S. Appl. No. 12/252,693, filed Oct. 16, 2008, Sakata.

*Primary Examiner* — William J Royer
(74) *Attorney, Agent, or Firm* — Oblon, Spivak, McClelland, Maier & Neustadt, L.L.P.

(57) ABSTRACT

A developing unit used in an image forming apparatus with a latent image carrier includes a developer carrier, a supply compartment, a recovery compartment, a separation member, and a gap. The developer carrier facing the latent image carrier rotates while carrying two-component developer containing toner and carrier and supplies the toner to the latent image. The supply compartment includes a supply transport member to transport the developer in a first direction. The recovery compartment includes a recovery transport member to transport the developer in a second direction. The separation member includes one end portion facing the latent image carrier at a facing area. The separation member separates the supply compartment and the recovery compartment and is disposed above the recovery compartment behind the separation member. The gap is provided at the facing area. The gap has a width of not more than 1.4 millimeters.

18 Claims, 10 Drawing Sheets

U.S. PATENT DOCUMENTS

| | | | |
|---|---|---|---|
| 2008/0014527 | A1 | 1/2008 | Kotsugai et al. |
| 2008/0025761 | A1 | 1/2008 | Yoshida |
| 2008/0038021 | A1 | 2/2008 | Tsuda et al. |
| 2008/0063433 | A1 | 3/2008 | Miyamoto et al. |
| 2008/0085138 | A1 | 4/2008 | Yoshida |

FOREIGN PATENT DOCUMENTS

| | | |
|---|---|---|
| JP | 11-167260 | 6/1999 |
| JP | 2000-89514 | 3/2000 |
| JP | 3127594 | 11/2000 |
| JP | 2001-356527 | 12/2001 |
| JP | 2002-82484 | 3/2002 |
| JP | 2002-287400 | 10/2002 |
| JP | 2002-351143 | 12/2002 |
| JP | 2003-263012 | 9/2003 |
| JP | 2006-154193 | 6/2006 |
| JP | 2006-301167 | 11/2006 |
| JP | 3957037 | 5/2007 |

* cited by examiner

DEVELOPING UNIT, PROCESS CARTRIDGE, AND IMAGE FORMING METHOD AND APPARATUS INCORPORATING AN AGITATION COMPARTMENT

CROSS-REFERENCE TO RELATED APPLICATIONS

The present patent application claims priority under 35 U.S.C. §119 from Japanese Patent Application Nos. 2007-118351, filed on Apr. 27, 2007, and 2007-274206, filed on Oct. 22, 2007 in the Japanese Patent Office, the entire contents of each of which are hereby incorporated herein by reference.

BACKGROUND OF THE INVENTION

1. Field of the Invention

The present invention relates generally to a developing unit used in copiers, facsimile machines, printers, or other image forming apparatuses, and more specifically, to a developing unit using a two-component developer containing toner and magnetic carrier, a process cartridge using the developing unit, and an image forming method and apparatus using the developing unit.

2. Description of the Background

An image forming apparatus used as a copier, facsimile machine, printer, or multi-functional device thereof may have a developing unit to develop an image with two-component developer containing toner and carrier.

Such a conventional developing unit has a configuration as illustrated in FIG. 1, for example. In FIG. 1, a conventional developing unit 104 has two developer compartments, that is, a supply recovery compartment 402 including a supply screw 401 and an agitation compartment 10 including an agitation screw 11. The supply recovery compartment 402 and the agitation compartment 10 transport developer in opposite directions to circulate the developer in the conventional developing unit 104.

In the conventional developing unit 104, the developer is supplied from the supply recovery compartment 402 to a surface of a developing roller 5 and is used for development in a development area in which the developing roller 5 faces a photoconductor, not illustrated. After passing through the development area, the developer is recovered from the developing roller 5 to the supply recovery compartment 402.

In the conventional developing unit 104, a single compartment, that is, the supply recovery compartment 402 performs both functions of supplying developer to the developing roller 5 and recovering the developer passed through the development area. Consequently, on a downstream side of the supply recovery compartment 402 in its developer transport direction, the concentration of toner in the developer to be supplied to the developing roller 5 may decrease, thereby resulting in failures such as a reduction in image density during a development process.

Accordingly, certain conventional developing units have a supply transport member that supplies and transports developer to the developing roller and a separate recovery transport member that recovers and transports the developer passed through the development area in separate developer compartments.

FIG. 2 illustrates one type of conventional developing unit 204 having such configuration adjacent a photoconductor 1.

The conventional developing unit 204 separately has a supply compartment 9 to supply developer to a developing roller 5 and a recovery compartment 7 to recover the developer passed through a development area. As illustrated in FIG. 2, the conventional developing unit 204 has a separation member 133 separating the supply compartment 9 and the recovery compartment 7, which recovery compartment includes a recovery screw 6. The separation member 133 has an end portion 133*a* facing the developing roller 5. The supply compartment 9 and the recovery compartment 7 each are disposed to face the developing roller 5. The supply compartment 9 is disposed above the recovery compartment 7 behind the separation member 133. FIG. 2 also depicts a gap Gp, between the developing roller 5 and a supply screw 8.

In the conventional developing unit 204 thus configured, the developer passed through the development area is transported to the recovery compartment 7 and thus is not mixed into the supply compartment 9. Such configuration eliminates a change in toner concentration of the developer transported to the supply compartment 9, thereby allowing the toner concentration of developer supplied to the developing roller 5 to be maintained substantially constant.

FIG. 3 illustrates another type of conventional developing unit 304.

The conventional developing unit 304 has a supply compartment 9 to supply developer to a developing roller 5 and a separate recovery compartment 7 to recover the developer passed through a development area. The conventional developing unit 304 also has an agitation compartment 10 that agitates excess developer, transported to a downstream end portion of the supply compartment 9, and recovered developer, transported to a downstream end portion of the recovery compartment 7, which includes a recover screw 6, into agitated developer and simultaneously transports the agitated developer in a direction opposite to the developer transport direction of the supply compartment 9.

As illustrated in FIG. 3, the conventional developing unit 304 also has a separation member 133 separating the supply compartment 9 (and associated supply screw 8) and the recovery compartment 7 (and associated agitation screw 11). The supply compartment 9 and the recovery compartment 7 are disposed to face the developing roller 5. The separation member 133 has an end portion 133*a* facing the developing roller 5. The supply compartment 9 is disposed above the recovery compartment 7 behind the separation member 133.

As is the case with the conventional developing unit 204 described above, in the conventional developing unit 304 thus configured, the developer passed through the development area is transported to the recovery compartment 7 and thus is not mixed into the supply compartment 9. Such configuration eliminates a change in toner concentration of the developer transported to the supply compartment 9, thereby allowing the toner concentration of developer supplied to the developing roller 5 to be maintained substantially constant.

As illustrated in FIGS. 2 and 3, in each of the conventional developing units 204 and 304, the supply compartment 9 is disposed above the recovery compartment 7 behind the separation member 133, which has the end portion 133*a* facing the developing roller 5. However, such configuration may result in failures depending on the size of a gap between the end portion 133*a* and the developing roller 5.

For example, if the gap between the end portion 133*a* and the developing roller 5 is too great, a portion of developer in the supply compartment 9 may not appropriately be supplied to the developing roller 5 and may drop through the gap into the recovery compartment 7.

Such dropping of developer into the recovery compartment 7 may result in failures as follows. Specifically, when the developer dropping through the gap reaches the recovery compartment 7 in addition to the developer supplied to the developing roller 5 from the supply compartment 9, the amount of developer consumed from the supply compartment 9 may increase. Consequently, developer may run short in a downstream portion of the supply compartment 9 in its developer transport direction, thereby resulting in shortage of developer to be supplied to the developing roller 5.

Further, such dropping of developer into the recovery compartment 7 may increase the amount of developer contained in the recovery compartment 7. As a result, the thickness of developer may increase on the downstream side of the recovery compartment 7 in its developer transport direction, thereby preventing the developer on the surface of the developing roller 5 from appropriately dropping to the recovery compartment 7 after a developing process.

Further, such preventing may result in a so-called "taking-around" phenomenon, in which, after passing through the development area, the developer remains on the surface of the developing roller 5, passes through a facing area in which the developing roller 5 faces the supply compartment 9, and reaches the development area again. Such taken-around developer may repeatedly pass through a doctor gap 5*a* and thus be degraded by friction, thereby resulting in uneven degradation of developer.

Further, such taken-around developer may be heated by friction at the doctor gap 5*a*. Accordingly, if the taking-around phenomenon occurs when using a toner having a low melting point, the toner is repeatedly heated at the doctor gap 5*a* before being cooled down, thereby causing the toner to be melted while being taken around with each rotation of the developing roller 5. Such melting of toner in two-component developer carried on the developing roller 5 may result in such failures as, for example, fusion of the toner on the developing roller 5, or aggregation of toner particles.

Consequently, there is still a need for a developing unit, process cartridge, image forming method and apparatus capable of preventing failures that may be caused by developer dropping through a gap between a developer carrier and an end portion of a separation member.

SUMMARY OF THE INVENTION

Exemplary embodiments of the present invention provide a developing unit, process cartridge, image forming method and apparatus capable of preventing failures that may be caused by developer dropping through a gap between a developer carrier and an end portion of a separation member.

In one exemplary embodiment of the present invention, a developing unit used in an image forming apparatus with a latent image carrier having a surface to carry a latent image thereon includes a developer carrier, a supply compartment, a recovery compartment, a separation member, and a gap. The developer carrier is disposed to face the latent image carrier and configured to rotate while carrying two-component developer containing toner and magnetic carrier and to supply the toner to the latent image, carried on the surface of the latent image carrier, in a development area in which the developer carrier faces the latent image carrier. The supply compartment includes a supply transport member configured to transport the developer in a first direction parallel to an axial direction of the developer carrier and to supply the developer to the developer carrier. The recovery compartment includes a recovery transport member configured to transport the developer, recovered from the developer carrier after passing through the development area, in a second direction parallel to the axial direction of the developer carrier. The separation member includes one end portion disposed to face the surface of the latent image carrier at a facing area. The separation member is disposed to separate the supply compartment and the recovery compartment. The supply compartment is disposed above the recovery compartment behind the separation member. The gap is provided at the facing area at which the one end portion of the separation member faces the developer carrier.

In some embodiments, the gap may have a width of not more than 1.4 millimeters. In other embodiments, the gap may be not more than 0.8 millimeters.

BRIEF DESCRIPTION OF THE DRAWINGS

A more complete appreciation of the disclosure and many of the attendant advantages thereof will be readily acquired as the same becomes better understood by reference to the following detailed description when considered in connection with the accompanying drawings, wherein.

Figure 1:
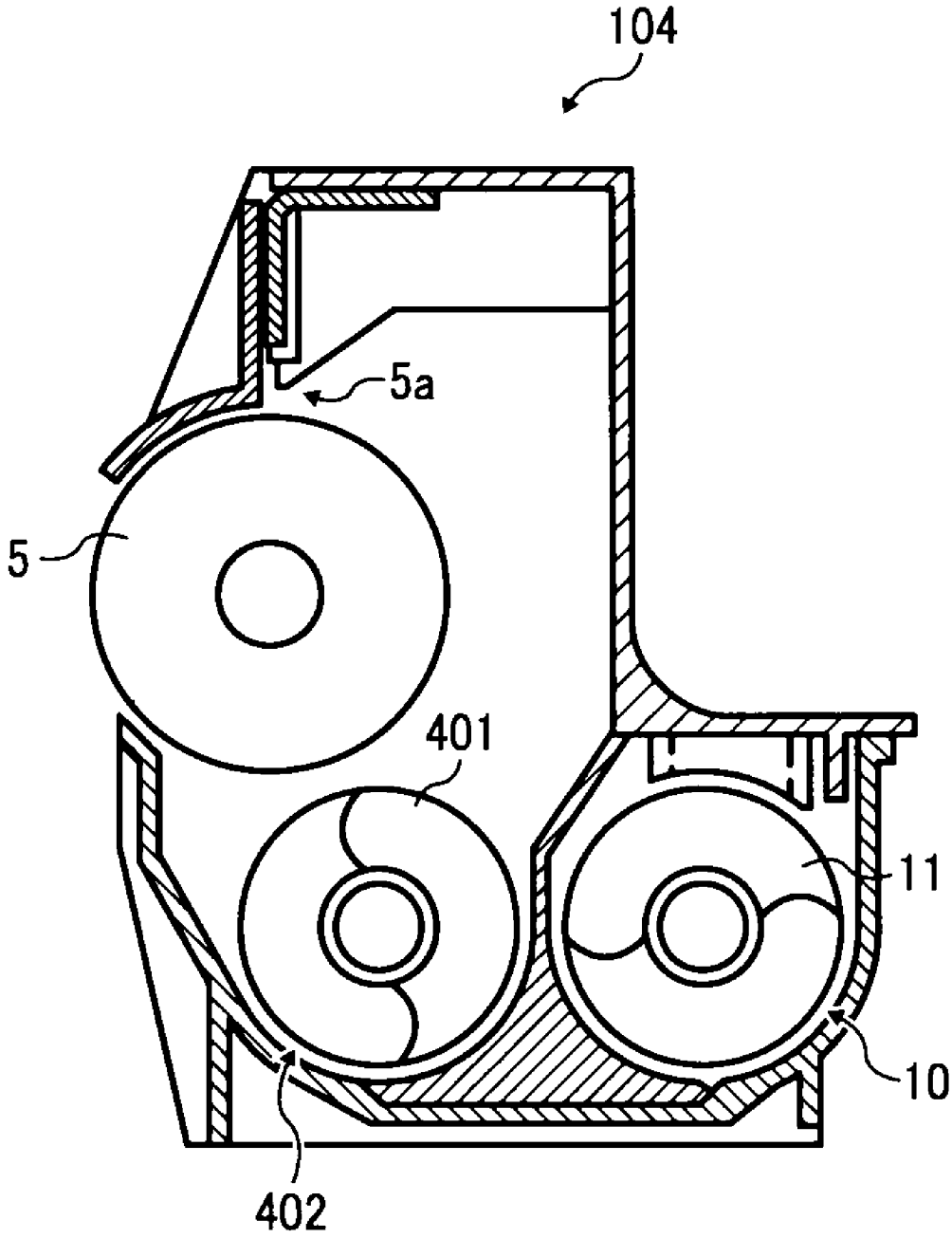
FIG. 1 RELATED ART
FIG. 1 is a schematic view illustrating a conventional developing unit.

The accompanying drawings are intended to depict exemplary embodiments of the present disclosure and should not be interpreted to limit the scope thereof. The accompanying drawings are not to be considered as drawn to scale unless explicitly noted.

DETAILED DESCRIPTION OF EXEMPLARY EMBODIMENTS

In describing exemplary embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve the same results. For the sake of simplicity, the same reference numerals are used in the drawings and the descriptions for the same materials and constituent parts having the same functions, and redundant descriptions thereof are omitted.

Exemplary embodiments of the present disclosure are now described below with reference to the accompanying drawings. It should be noted that, in a later-described comparative example, exemplary embodiment, and alternative example, the same reference numerals are used for the same constituent elements such as parts and materials having the same functions and achieving the same effects, and redundant descriptions thereof are omitted.

Hereinafter, an image forming apparatus 500 according to an exemplary embodiment of the present invention is described with reference to FIG. 4. In the following description, the image forming apparatus 500 is described as a color laser copier having a plurality of photoconductors arranged in a tandem manner but may be any other suitable type of image forming apparatus.

Figure 4:
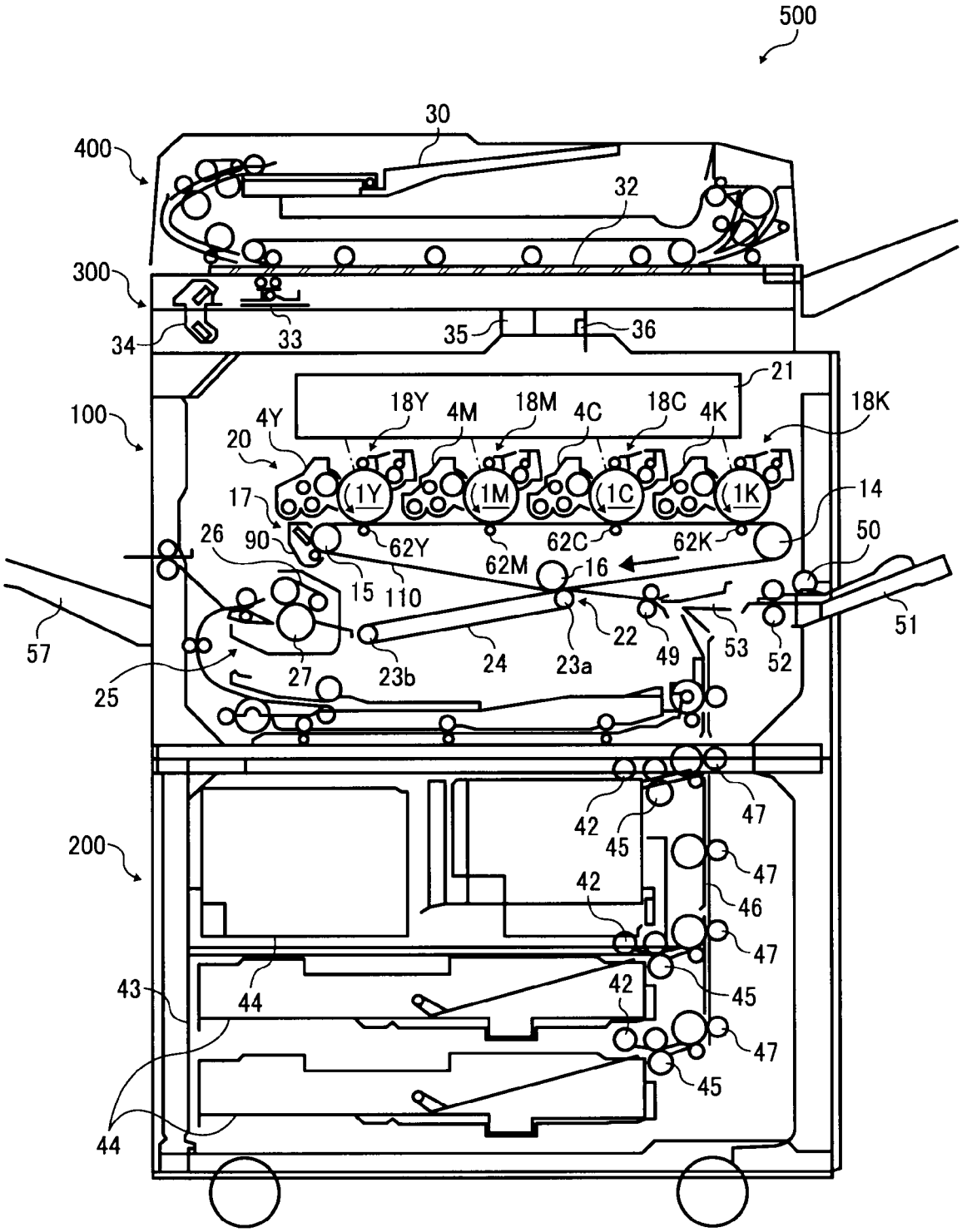
FIG. 4 is a schematic view illustrating an image forming apparatus according to an exemplary embodiment of the present invention.

FIG. 4 illustrates a schematic configuration of the image forming apparatus 500. In FIG. 4, the image forming apparatus 500 has a printing unit 100, a sheet feed unit 200, a scanner 300, and an automatic document feeder (ADF) 400, for example. The printing unit 100 is disposed on the sheet feed unit 200, the scanner 300 is fixed on the printing unit 100, and the ADF 400 is fixed on the scanner 300.

The printing unit 100 has an image forming unit 20. As illustrated in FIG. 4, the image forming unit 20 may include process cartridges 18Y, 18M, 18C, and 18K for forming images of yellow (Y), magenta (M), cyan (C), and black (K), respectively. Hereinafter, the characters Y, M, C, and K represent yellow, cyan, magenta, and black colors, respectively.

The printing unit 100 also includes an optical writing unit 21, an intermediate transfer unit 17, a secondary transfer unit 22, registration rollers 49, and a fixing unit 25 of a belt type, for example.

The optical writing unit 21 has a light source, polygon mirror, f-theta lens, and reflecting mirror, which are not illustrated. The optical writing unit 21 directs a laser beam onto a surface of each photoconductor 1, described later, based on image data.

Each of the process cartridges 18Y, 18M, 18C, and 18K includes a photoconductor 1 having a drum shape, a charger, a developing unit 4, a drum cleaner, and a discharger.

In FIG. 4, the process cartridges 18Y, 18M, 18C, and 18K have similar configurations, and therefore the process cartridge 18Y is used below as a representative example to describe an image forming operation.

When the charger uniformly charges a surface of a photoconductor 1Y of the process cartridge 18Y, a laser beam modulated and deflected by the optical writing unit 21 is directed onto the charged surface of the photoconductor 1Y. As a result, the electric potential of an area illuminated or exposed by the laser beam may become lower than the electric potential of a similar area that is not illuminated by the laser beam, thereby forming an electrostatic latent image for yellow toner on the surface of the photoconductor 1Y. The electrostatic latent image is then developed by the developing unit 4Y into a yellow toner image.

The yellow toner image formed on the photoconductor 1Y is primarily transferred onto an intermediate transfer belt 110 described later. After the primary transfer, the drum cleaning unit cleans residual toner remaining on the surface of the photoconductor 1Y. Then, the discharger discharges the photoconductor 1Y, thereby allowing the photoconductor 1Y to be ready for another image forming operation.

Similarly, the above-described image forming operation is performed by each of the other process cartridges 18M, 18C, and 18K.

Next, the intermediate transfer unit 17 is described below.

In FIG. 4, the intermediate transfer unit 17 includes the intermediate transfer belt 110, a belt cleaner 90, a tension roller 14, a drive roller 15, a secondary-transfer backup roller 16, and primary-transfer bias rollers 62Y, 62M, 62C, and 62K.

The intermediate transfer belt 110 is extended by a plurality of rollers including the tension roller 14. The intermediate transfer belt 110 is rotated in a clockwise direction in FIG. 4 with rotation of the drive roller 15 driven by a belt drive motor, not illustrated.

The primary-transfer bias rollers 62Y, 62M, 62C, and 62K contact an inner surface of the intermediate transfer belt 110 and receive a primary-transfer bias voltage supplied from a power source. The primary-transfer bias rollers 62Y, 62M, 62C, and 62K press the intermediate transfer belt 110 against the photoconductors 1Y, 1M, 1C, and 1K, respectively, to form primary transfer nips. At each of the primary transfer nips, the primary-transfer bias voltage generates a primary-transfer electrical field between the photoconductor 1 and primary-transfer bias roller 62.

The yellow toner image formed on the photoconductor 1Y is primarily transferred onto the intermediate transfer belt 110 by action of the primary-transfer electrical field and pressure generated at the primary transfer nip. Magenta, cyan, and black toner images formed on the photoconductor 1M, 1C, and 1K, respectively, are sequentially superimposed on the yellow toner image at respective primary transfer nips. Thus, by superimposing the respective color toner images during the primary transfer process, a four-color toner image is formed on the intermediate transfer belt 110.

The four-color toner image on the intermediate transfer belt 110 is secondarily transferred to a recording sheet such as a transfer paper sheet at a secondary transfer nip described later.

After the secondary transfer, the belt cleaner 90 cleans residual toner remaining on the intermediate transfer belt 110 by sandwiching the intermediate transfer belt 110 with the drive roller 15.

Next, the secondary transfer unit 22 is described.

In FIG. 4, the secondary transfer unit 22 is disposed below the intermediate transfer unit 17. In the secondary transfer unit 22, a sheet transport belt 24 is extended by tension rollers 23*a* and 23*b*. At least one of the tension rollers 23*a* and 23*b* is rotationally driven to endlessly move the sheet transport belt 24 in a counter-clockwise direction in FIG. 4.

As illustrated in FIG. 4, the tension roller 23*a*, disposed on the right side of the secondary transfer unit 22, sandwiches the intermediate transfer belt 110 and the sheet transport belt 24 together with the secondary-transfer backup roller 16. Such sandwiching forms a secondary transfer nip at which the intermediate transfer belt 110 of the intermediate transfer unit 17 contacts the sheet transport belt 24 of the secondary transfer unit 22.

When the tension roller 23*a* receives, from a power source, a secondary-transfer bias voltage having a polarity opposite a polarity of toner, a secondary-transfer electrical field is formed at the secondary transfer nip, thereby allowing a four-color toner image on the intermediate transfer belt 110 to be electrostatically transferred toward the tension roller 23*a*.

Registration rollers 49 described later feed, to the secondary transfer nip, a recording sheet at a timing synchronized with a timing at which the four-color toner image on the intermediate transfer belt 110 reaches the secondary transfer nip. Then, the four-color toner image is secondarily transferred onto the recording sheet by action of the secondary-transfer electrical field and pressure generated at the secondary transfer nip.

It should be noted that the recording sheet may be charged by a non-contact type charger instead of the tension rollers 23*a* and 23*b* described above.

In FIG. 4, the sheet feed unit 200 is disposed at a lower portion of the image forming apparatus 500 and has a sheet bank 43 including a plurality of sheet cassettes 44. The plurality of sheet cassettes 44 are vertically stacked in the sheet bank 43 and capable of storing a plurality of recording sheets. Each sheet cassette 44 has a feed roller 42 that is pressed against a top recording sheet of the recording sheets stored therein. Rotating the feed roller 42 allows the top recording sheet to be fed to a sheet transport route 46.

The sheet transport route 46 is provided with a plurality of transport rollers 47 and the registration rollers 49, which is disposed at one end portion of the sheet transport route 46. The recording sheet is transported to the registration rollers 49 through the sheet transport route 46 and sandwiched by the registration rollers 49.

Meanwhile, the four-color toner image formed on the intermediate transfer belt 110 in the intermediate transfer unit 17 is transported to the secondary transfer nip while traveling on the intermediate transfer belt 110.

The registration rollers 49 feed the recording sheet to the secondary transfer nip at a given timing so that the four-color toner image is transferred onto the recording sheet from the intermediate transfer belt 110. Thus, a desired full-color image is formed on the recording sheet. The recording sheet having the full-color image is transported to the fixing unit 25 with traveling of the sheet transport belt 24.

In FIG. 4, the fixing unit 25 includes a belt unit and a pressure roller 27. The belt unit also has a fixing belt 26 and two, first and second, rollers. The fixing belt 26 is extended and rotated endlessly by the two rollers. The pressure roller 27 is pressed against the first roller of the belt unit. The fixing belt 26 contacts the pressure roller 27 to form a fixing nip therebetween. The recording sheet, transported by the sheet transport belt 24, is sandwiched by the fixing belt 26 and the pressure roller 27 at the fixing nip.

The first roller in the belt unit has a heat source, not illustrated, to heat the fixing belt 26. The fixing belt 26, heated by the heat source, heats the recording sheet at the fixing nip. The applied heat and pressure generated at the fixing nip allows the full-color image to be fixed on the recording sheet.

After the fixing process in the fixing unit 25, the recording sheet is ejected to a tray 57 provided on a side of the image forming apparatus 500. Alternatively, the recording sheet may be transported to the secondary transfer nip again to form a toner image on another surface of the recording sheet.

When copying a stack of document sheets, the stack of document sheets may be set on a document tray 30 of the ADF 400. Alternatively, when a stack of document sheets is bound like a book, the stack of document sheets may be directly placed on a contact glass 32 of the scanner 300 by opening the ADF 400. Then, the stack of document sheets is brought into contact with the contact glass 32 by closing the ADF 400.

After setting the document sheets, pressing a start button or the like allows the scanner 300 to start a document scanning operation.

In this regard, when document sheets are set on the ADF 400, the ADF 400 is capable of automatically feeding the document sheets one by one to the contact glass 32 prior to starting the document scanning operation.

In FIG. 4, the scanner 300 has a first carriage 33 and a second carriage 34, a focus lens 35, and a scanning sensor 36. The first carriage 33 has a light source, and the second carriage 34 has a mirror.

For such document scanning operation, when the first carriage 33 and the second carriage 34 start to move, the light source of the first carriage 33 emits a light toward a surface of a document sheet placed on the contact glass 32. Light reflected from the surface of a document sheet is reflected by the mirror in the second carriage 34, passes through the focus lens 35, and enters the scanning sensor 36. The scanning sensor 36 creates image data based on such light.

During such document scanning operation, certain units in the process cartridges 18Y, 18M, 18C, 18K, the intermediate transfer unit 17, the secondary transfer unit 22, and the fixing unit 25 are activated. Based on the image data created by the scanning sensor 36, the optical writing unit 21 is driven to write latent images on the photoconductors 1Y, 1M, 1C, and 1K. Such latent images are developed as Y, M, C, and K toner images on the photoconductors 1Y, 1M, 1C, and 1K, respectively. Such toner images are superimposingly transferred on the intermediate transfer belt 110 to form a four-color toner image.

When the document scanning operation is started, the sheet feed unit 200 starts sheet feed operation. In the sheet feed operation, when one sheet feed cassette 44 is selected from among the plurality of sheet feed cassettes 44, the feed roller 42 of the selected cassette 44 is rotationally driven to feed recording sheets stored therein. The recording sheets are separated by a separation roller 45, forwarded one by one to the sheet transport route 46, and transported to the secondary transfer nip by the transport rollers 47.

Alternatively, recording sheets may be fed from a manual feed tray 51. In such a case, a feed roller 50 is rotated to feed recording sheets from the manual feed tray 51 to separation rollers 52. The recording sheets are separated by the separation rollers 52 and forwarded one by one to a feed route 53 in the printing unit 100.

When forming a multi-color image, the image forming apparatus 500 is capable of holding an upper extending surface of the intermediate transfer belt 110 substantially horizontal so that the upper extending surface is in contact with all the photoconductors 1Y, 1M, 1C, and 1K.

On the other hand, when forming a monochrome image with only K toner, for example, the intermediate transfer belt 110 is inclined relative to such a horizontal direction by an inclining mechanism, not illustrated, so that the upper extending surface is detached from the photoconductors 1Y, 1M, and 1C. The photoconductor 1K is then rotated in a counterclockwise direction in FIG. 4 to form a K toner image on the photoconductor 1K.

For such monochrome image forming operation, the photoconductors 1Y, 1M, and 1C and developing units 4Y, 4M, and 4C may be deactivated to prevent wasteful use thereof.

The image forming apparatus 500 may also include a control unit and a display unit. The control unit includes a CPU (central processing unit) to control various units and devices in the image forming apparatus 500, and the display unit may include a liquid crystal display, and keys and buttons for operational input, for example.

An operator can send instructions to the control unit by inputting information through the display unit. For example, an operator can select one mode from among three modes for simplex printing, which forms an image on one surface of a recording sheet. The three modes may be a direct simplex print mode, a reverse output mode, and a reverse decurling output mode, for example.

Figure 5:
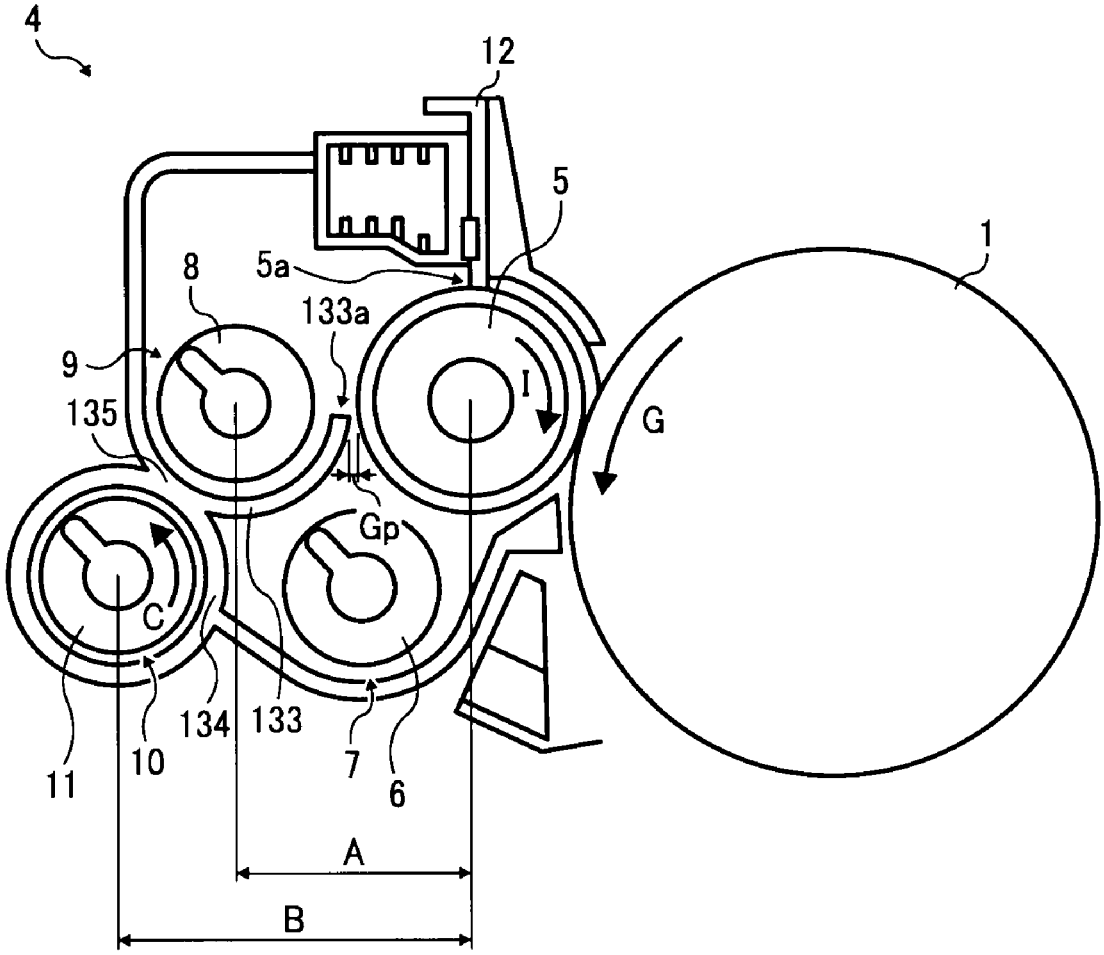
FIG. 5 is a schematic view illustrating a developing unit according to an exemplary embodiment of the present invention.

FIG. 5 is an enlarged view illustrating configurations of the developing unit 4 and photoconductor 1 useable in the process cartridges 18Y, 18M, 18C, and 18K. The process cartridges 18Y, 18M, 18C, and 18K have similar configurations except toner color, and therefore the suffixes of Y, M, C, and K are omitted in FIG. 5 for simplicity.

While the photoconductor 1 is rotated in a direction indicated by an arrow G in FIG. 5, the charger, not illustrated, charges the surface of the photoconductor 1. The optical writing unit 21 irradiates the charged surface of the photoconductor 1 with a laser beam to write an electrostatic latent image on the photoconductor 1. The developing unit 4 supplies toner to develop the latent image into a toner image.

As illustrated in FIG. 5, the developing unit 4 includes a developing roller 5 serving as a developer carrier. The developing roller 5 rotates in a direction indicated by an arrow "I" in FIG. 5 to supply toner to a latent image formed on the surface of the photoconductor 1 to develop the latent image into a toner image.

The developing unit 4 also includes a supply screw 8 serving as a supply transport member. For example, the supply screw 8 has a spiral shape and is disposed parallel to an axial direction of the developing roller 5. In such a case, the supply screw 8 may transport developer from the rear side to the front side in FIG. 5 along the axial direction of the developing roller 5 while supplying the developer to the developing roller 5.

The developing unit 4 also includes a doctor blade 12 for regulating thickness of the developer supplied on the developing roller 5. The doctor blade 12, serving as a developer regulating member, sets the thickness of the developer on the developing roller 5 at a preferred level for a developing process.

The developing unit 4 also includes a recovery compartment 7 for recovering developer passed through a development area. The recovery compartment 7 faces the developing roller 5 on a downstream side of a development area, at which the developing roller 5 faces the photoconductor 1, in the rotating direction I. The recovery compartment 7 includes a recovery screw 6 having a spiral shape. The recovery screw 6 is disposed parallel to the axial direction of the developing roller 5 and serves as a recovery transport member to transport the recovered developer along the axial direction of the developing roller 5, which is the same direction as the direction in which the supply screw 8 transports developer.

The developing unit 4 also includes a supply compartment 9 that has the supply screw 8 and serves as a supply transport passage for developer. The supply compartment 9 is disposed alongside the developing roller 5, and the recovery compartment 7 including the recovery screw 6 is disposed below the developing roller 5.

The developing unit 4 also includes an agitation compartment 10 serving as an agitation transport passage for developer. The agitation compartment 10 is disposed below the supply compartment 9 and alongside the recovery compartment 7.

The agitation compartment 10 includes an agitation screw 11. The agitation screw 11 has a spiral shape and is disposed parallel to the axial direction of the developing roller 5. The agitation screw 11 agitates and transports developer in a direction from the front side to the rear side in FIG. 5, that is, a direction opposite to the developer transport direction of the supply screw 8.

The developing unit 4 also includes a first separation wall 135 separating the supply compartment 9 and the agitation compartment 10.

The first separation wall 135 has openings, described later, near upstream and downstream ends in the developer transport direction of the supply screw 8 in the supply compartment 9. The supply compartment 9 and the agitation compartment 10 are communicated via the openings. In other words, the first separation wall 135 has the openings connecting the supply compartment 9 and the agitation compartment 10 near both ends on the front and rear sides of FIG. 5.

The developing unit 4 also includes a second separation wall 134 separating the agitation compartment 10 and the recovery compartment 7. The second separation wall 134 has an opening, described later, near a downstream end in the developer transport direction of the recovery screw 6 in the recovery compartment 7. In other words, the second separation wall 134 has the opening connecting the agitation compartment 10 and recovery compartment 7 near the end on the front side of FIG. 5.

The developing unit 4 also includes a separation member 133 separating the supply compartment 9 and the recovery compartment 7. The separation member 133 has no opening connecting the supply compartment 9 and the recovery compartment 7.

As illustrated in FIG. 5, the separation member 133 has one end portion 133*a* which, in cross section, is perpendicular to the axial direction of the developing roller 5. The end portion 133*a* faces the surface of the developing roller 5.

The supply compartment 9 is disposed above the recovery compartment 7, from which it is separated by the separation member 133.

The above-described supply screw 8, recovery screw 6, and agitation screw 11 are made of metal material or resin material, for example. The diameter, screw pitch, and rotation speed of each screw are 22 mm, 25 mm, and 700 rpm (revolutions per minute), respectively.

When the doctor blade 12 made, for example, of stainless steel, forms the developer in a thin layer on the developing roller 5, the developer is conveyed to the development area, at which the developing roller 5 faces the photoconductor 1, to develop a latent image on the photoconductor 1 into a toner image.

The developing roller 5 has a surface subjected to V-shaped groove processing or electromagnetic blasting, for example. The developing roller 5 is made from, for example, aluminum pipe, having a certain diameter (e.g., 25 mm). The developing roller 5 has a certain gap (e.g., 0.3 mm) with each of the doctor blade 12 and the photoconductor 1. Hereinafter, the gap between the developing roller 5 and the doctor blade 12 is referred as a doctor portion 5*a*.

After the developing process, residual developer is recovered from the developing roller 5, transported into the recovery compartment 7, and then transported to the agitation compartment 10 through the opening in the second separation wall 134. The opening is provided in a non-image area, which is an area outside one end of the development area in the axial direction of the developing roller 5.

Although not illustrated in FIG. 5, the developing unit 4 has a toner supply port, described later, to refill the agitation compartment 10 with fresh toner. The toner supply port is provided at an upper portion of the agitation compartment 10 and near the opening in the second separation wall 134.

As described above, the developing unit 4 of FIG. 5 has the supply compartment 9 and the recovery compartment 7, so that supply and recovery operations of developer are performed in separate developer compartments.

Meanwhile, a portion of the developer passed through the development area may fly off by inertial force in the rotation direction "I" of the developing roller 5 and be transported to the development area again. The greater the diameter of the developing roller 5, as the rotation speed of the developing roller 5 is higher and/or the weight of developer is smaller, such phenomenon may be more notably observed.

Accordingly, when the image forming apparatus 500 is configured to be operable at high speed, the developing roller 5 may need to have a relatively large diameter and rotate at high speed. Further, carrier particles of developer may need to have a relatively small diameter.

Hence, the developing unit 4 according to the present exemplary embodiment has a gap Gp of approximately 0.7 mm between the developing roller 5 and the end portion 133*a* to suppress such phenomenon.

Next, circulation of developer in the above-mentioned compartments in the developing unit 4 is described.

Figure 6:
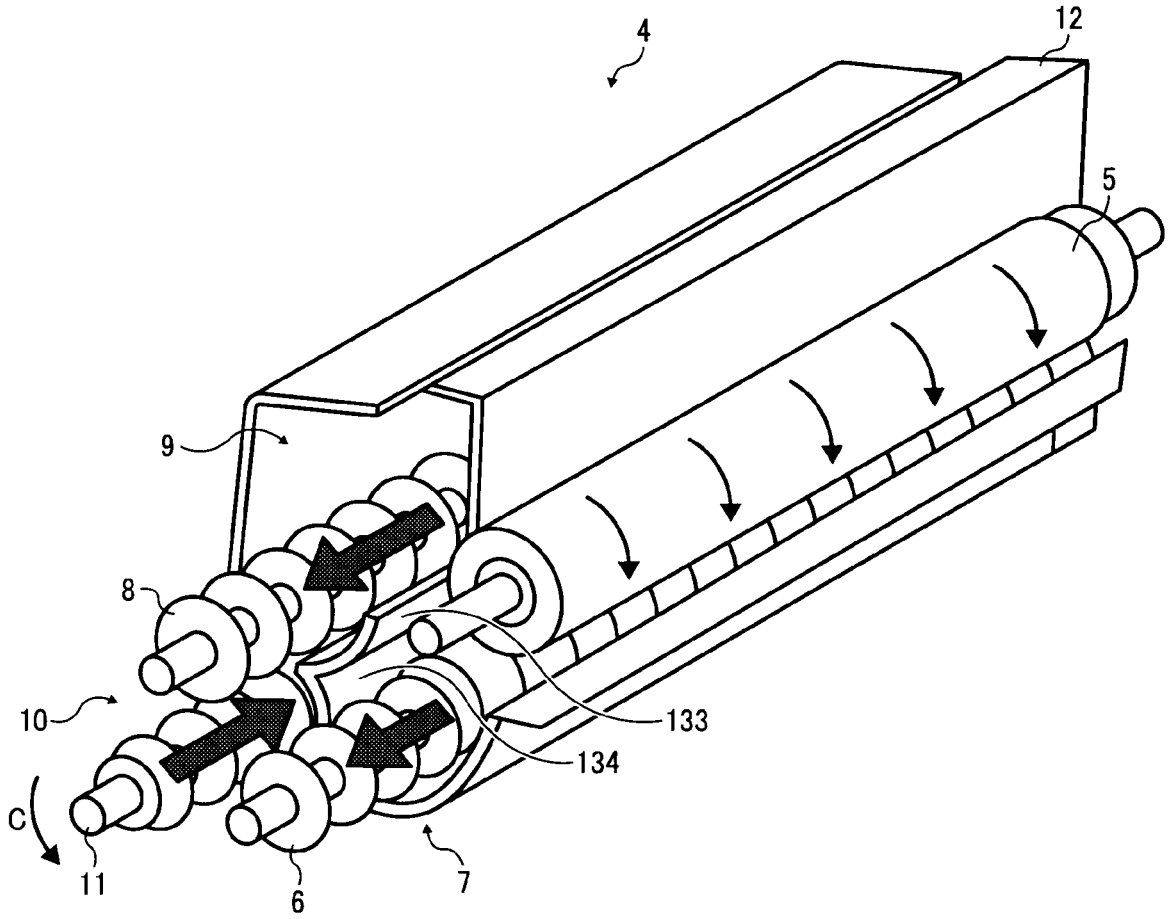
FIG. 6 is a perspective cross-sectional view illustrating direction of movements of developer in the developing unit of FIG. 5.

FIG. 6 illustrates a perspective view of the developing unit 4. Incidentally, in FIG. 6, some portions are omitted to show an internal configuration of the developing unit 4. Each arrow in FIG. 6 indicates a direction of movement of developer in the developing unit 4.

Figure 7:
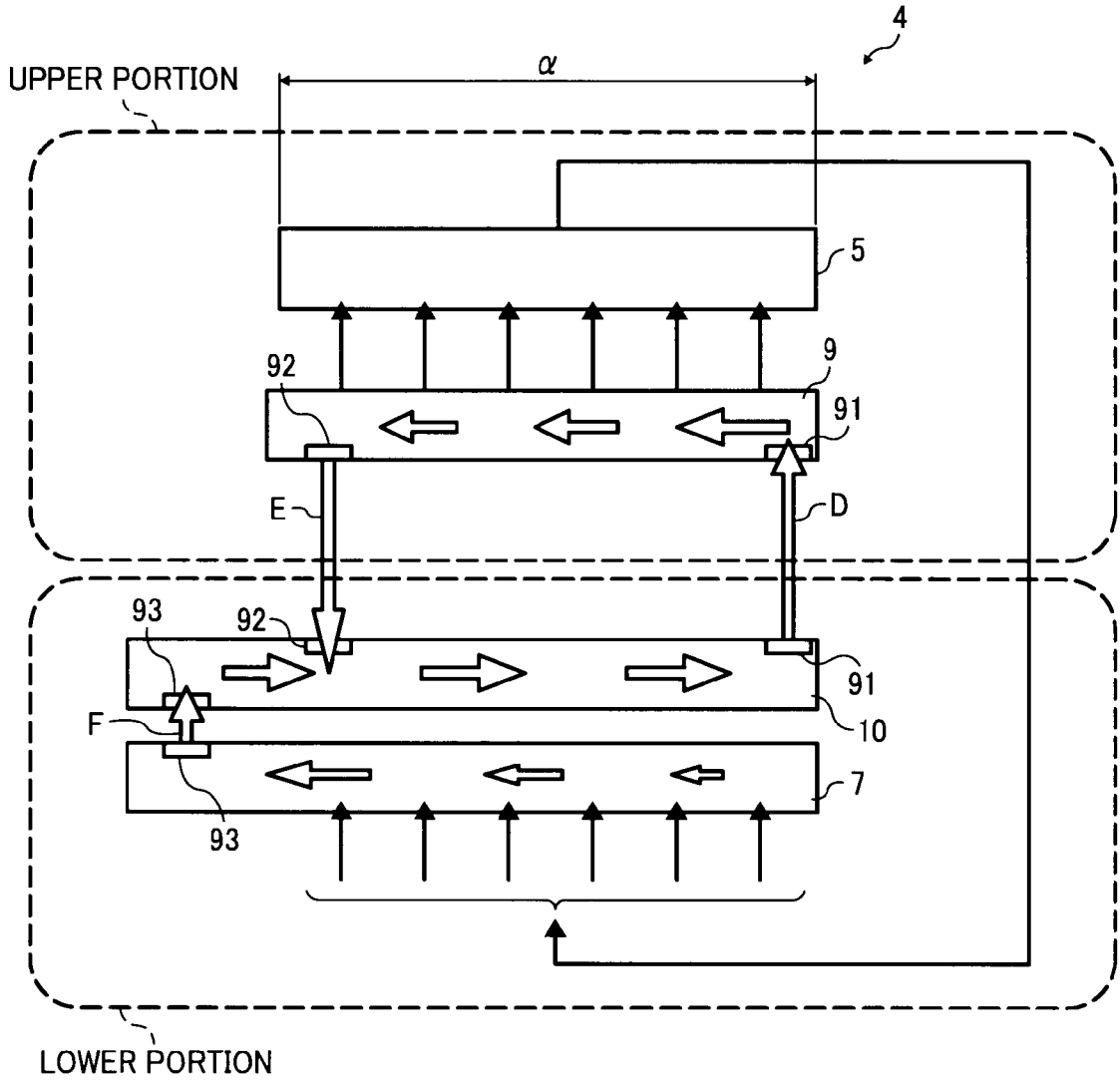
FIG. 7 is a schematic view illustrating a flow pattern of developer in the developer unit of FIG. 5.

FIG. 7 is a schematic view illustrating a flow pattern of developer in the developing unit 4. Similar to FIG. 6, each arrow in FIG. 7 illustrates a direction of movement of developer in the developing unit 4.

When developer is supplied from the agitation compartment 10 to the supply compartment 9, the supply screw 8 transports the developer to the downstream side of the supply compartment 9 while supplying the developer to the developing roller 5.

In actuality, some of the developer is not supplied to the developing roller 5 and not used for the developing process. Such un-used developer (hereinafter "excess developer") is transported to the downstream end portion of the supply compartment 9. Further, as indicated by arrow E in FIG. 7, such excess developer is transported to the agitation compartment 10 through an opening 92, which is provided on the front side of the first separation wall 135 in FIG. 5.

On the other hand, a portion of the developer supplied to the developing roller 5 is recovered into the recovery compartment 7. Such recovered developer is transported by the recovery screw 6 to the downstream end portion of the recovery compartment 7. Further, the recovered developer is transported to the agitation compartment 10 through the opening 93 in the second separation wall 134 as indicated by an arrow F in FIG. 7.

In the agitation compartment 10, the agitation screw 11 transports the excess developer and the recovered developer to the downstream end portion of the agitation compartment 10 while agitating the excess developer and the recovered developer into agitated developer. Further, as indicated by an arrow D in FIG. 7, the agitated developer is transported to the supply compartment 9 through an opening 91, which is provided at the rear side of the first separation wall 135 in FIG. 5.

In the agitation compartment 10, the developer agitated and transported by the agitation screw 11 may include the recovered developer, the excess developer, and the fresh toner, which is refilled to the agitation compartment 10 as needed. The agitation screw 11 also transports the agitated developer in a direction opposite the developer transport direction of the recovery compartment 7 and supply compartment 9.

The developer transported to the downstream end portion of the agitation compartment 10 is further transported to the upstream end portion of the supply compartment 9 through the opening 91, which connects the downstream end portion of the agitation compartment 10 and the upstream end portion of the supply compartment 9.

Although not illustrated in FIG. 7, a toner concentration sensor may be provided below the agitation compartment 10. Based on signals output from the toner concentration sensor, a toner refilling unit may be activated to refill toner from a toner container to the developing unit 4.

As described above, the developing unit 4 has the supply compartment 9 and recovery compartment 7 so that the supply and recovery operations of developer is conducted in separate developer compartments. Such configuration can prevent developer passed through the development area from mixing into the supply compartment 9, thereby suppressing uneven reduction in toner concentration of the developer on the downstream side of the supply compartment 9.

The developing unit 4 also has the recovery compartment 7 and the agitation compartment 10 so that the recovery and agitation operations are conducted in separate developer compartments. Such configuration can prevent the developer passed through the development area from dropping to the recovery compartment 7 during agitation, thereby allowing the developer to be supplied in a sufficiently agitated state to the supply compartment 9.

Thus, the developing unit 4 can suppress uneven reduction in toner concentration or insufficient agitation of developer in the supply compartment 9, thereby allowing the toner concentration of developer to be kept substantially uniform in the supply compartment 9.

In the developing unit 4, as illustrated in FIG. 7, the developer is transported from a lower portion to an upper portion, e.g., in a direction indicated by the arrow D. In such transport, the developer is pushed up by rotation of the agitation screw 11 in the agitation compartment 10 and thus supplied to the supply compartment 9.

However, such transport may cause stress on the developer, thereby reducing the service life of the developer. Further, such stress may result in damage to the surface layers of carriers in the developer or adherence of toner components to carriers, thereby degrading the image quality of a resultant image.

Accordingly, reducing such stress on the developer in the movement indicated by the arrow D may enhance the service life of the developer. Use of such service life-enhanced developer in the developing unit 4 can provide consistent high-quality imaging of relatively uniform image density.

In this regard, if the supply compartment 9 were positioned directly above the agitation compartment 10, the developer would need to be pushed up in a vertical direction from the agitation compartment 10 to the supply compartment 9, resulting in relatively great stress on the developer.

Hence, as illustrated in FIG. 5, in the developing unit 4, the supply compartment 9 is disposed obliquely above the agitation compartment 10. Such configuration can reduce stress on the developer when the developer is moved in the direction indicated by the arrow D in FIG. 7.

Further, such configuration also allows an upper wall face of the agitation compartment 10 to be positioned higher than a lower wall face of the supply compartment 9. By contrast, if the supply compartment 9 were disposed directly above the agitation compartment 10 as described above, the agitation screw 11 would need to push up the developer in a vertical direction against the force of gravity, resulting in relatively great pressure on the developer.

Hence, by setting the upper wall face of the agitation compartment 10 higher than the lower wall face of the supply compartment 9, the developing unit 4 allows the developer reaching a highest point of the agitation compartment 10 to flow downward naturally to a lowest point of the supply compartment 9 with the force of gravity, thereby reducing the stress on the developer.

The agitation screw 11 may be provided with a fin member on its shaft. For example, such fin member may be provided on the shaft near the openings portion at which the agitation compartment 10 connects the supply compartment 9.

Such fin member may include a plate member having one side extending parallel to the axial direction of the agitation screw 11 and another side extending perpendicular to the axial direction. Such fin member may stir the developer up so that the developer is efficiently transported from the agitation compartment 10 to the supply compartment 9.

Further, in the developing unit 4, a center-to-center distance "A" between the developing roller 5 and the supply compartment 9 is set smaller than a center-to-center distance "B" between the developing roller 5 and the agitation compartment 10 as illustrated in FIG. 5 (i.e., A<B). Such configuration allows the developer to be more easily supplied from the supply compartment 9 to the developing roller 5, thereby facilitating downsizing of the developing unit 4.

The agitation screw 11 is rotated in a counter-clockwise direction in FIG. 5 indicated by an arrow C so that the developer is pushed up along the shape of the agitation screw 11 to transport the developer to the supply compartment 9. Such a configuration allows the developer to be effectively pushed up, thereby reducing the stress on the developer during the transport.

As illustrated in FIG. 5, the agitation compartment 10 and the recovery compartment 7 are disposed at substantially identical heights in the developing unit 4. With such configuration, the developing unit 4 does not need to push up the recovered developer in the transport from the recovery compartment 7 to the agitation compartment 10 against the force of gravity, thereby reducing the stress on the developer.

Further, the supply compartment 9 is disposed higher than the agitation compartment 10 and the recovery compartment 7. Such configuration facilitates saving space in a horizontal direction of the developing unit 4 compared to a configuration in which the agitation compartment 10, the recovery compartment 7, and the supply compartment 9 are disposed at substantially identical heights.

Figure 8:
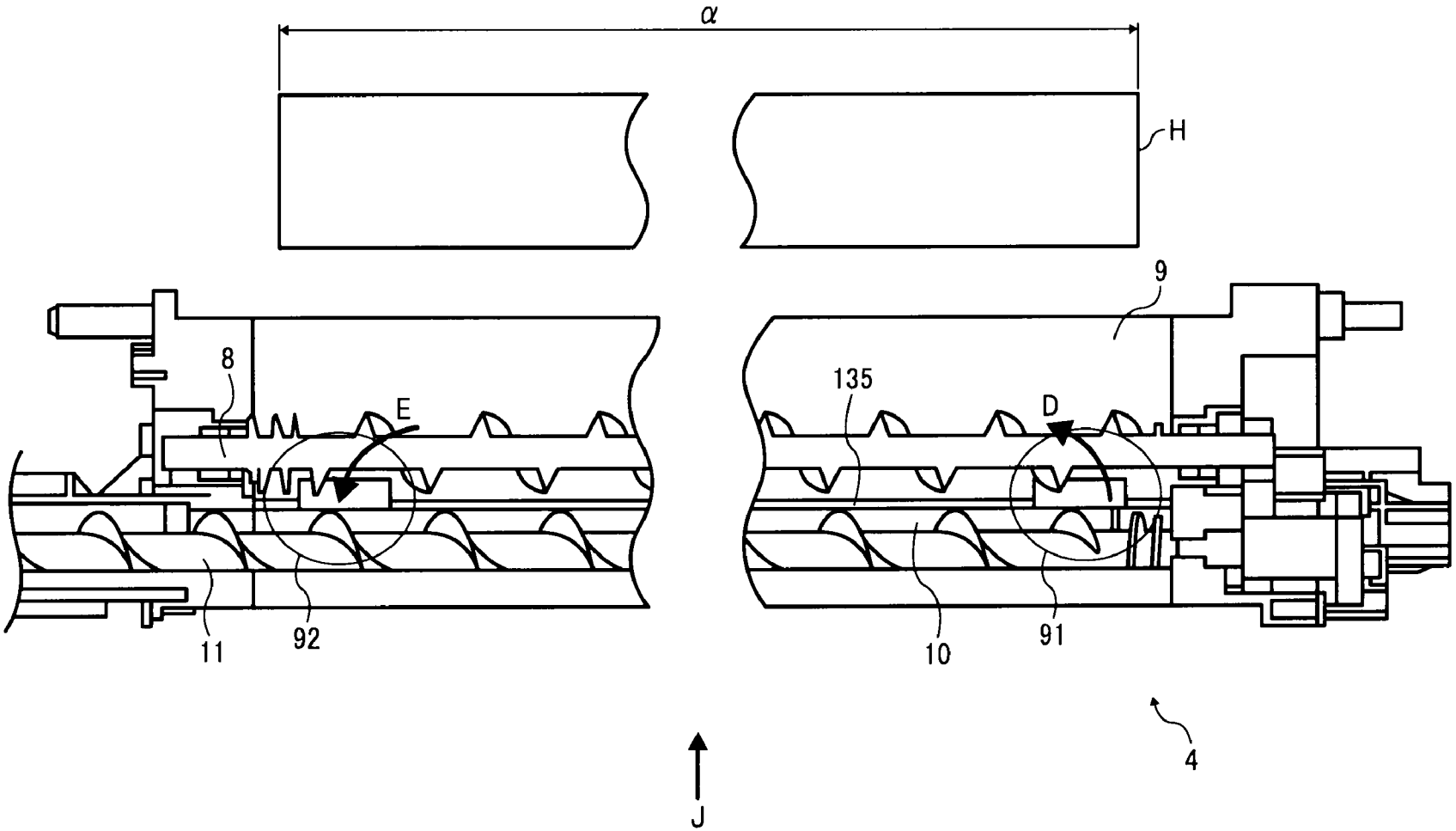
FIG. 8 is a cross-sectional view illustrating the developing unit of FIG. 5.

FIG. 8 is a cross-sectional view of the developing unit 4 along a direction indicated by an arrow J passing through a rotation central axis of the supply screw 8.

In FIG. 8, the developing roller 5 serving as a developer carrier supplies the developer to the development area "H" on the photoconductor 1 serving as a latent image carrier. The development area H has a width α (hereinafter "development area width α") extending in the axial direction of the rotation shaft of the developing roller 5.

As illustrated in FIG. 8, the opening 91, which connects the upstream end portion of the supply compartment 9 with the downstream end portion of the agitation compartment 10, is provided in the first separation wall 135 within the development area width α. In other words, the opening 91 is disposed on the first separation wall 135 between both ends of the developing roller 5 in the axial direction thereof.

Further, the opening 92, which connects the downstream end portion of the supply compartment 9 with the upstream end portion of the agitation compartment 10, is also provided in the first separation wall 135 within the development area width α. In other words, the opening 92 is disposed on the first separation wall 135 between both ends of the developing roller 5 in the axial direction thereof.

Thus, the developing unit 4 has the opening 91 through which the developer is pushed up from the agitation compartment 10 to the supply compartment 9 and the opening 92 through which the developer is flowed down from the supply compartment 9 to the agitation compartment 10. The opening 91 and opening 92 are disposed within the development area width α in the axial direction of the developing roller 5.

Figure 9:
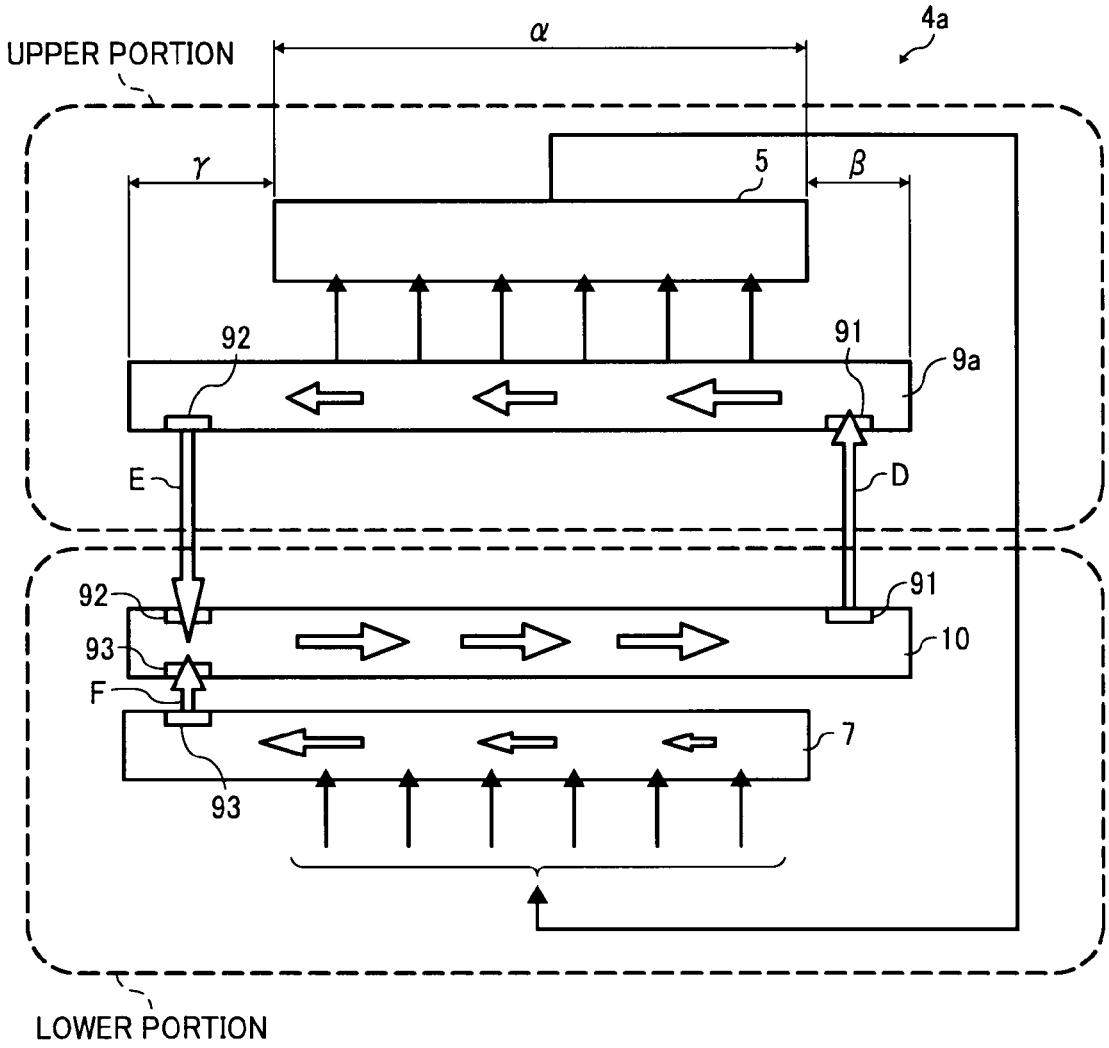
FIG. 9 is a schematic view illustrating a flow pattern of developer in a developing unit according to a comparative example.

FIG. 9 is a schematic view illustrating a flow pattern of developer in a developing unit 4*a* according to a comparative example.

As illustrated in FIG. 9, in the developing unit 4*a*, each of openings 91 and 92 is disposed outside a development area width α in a direction parallel to an axial direction of a developing roller 5.

In the comparative example, as illustrated in FIG. 9, a supply compartment 9*a* has a length greater than the development area width α of the developing roller 5 by a length β at an upstream end portion of the supply compartment 9*a*. The opening 91 is disposed outside the development area width α in the direction parallel to the axial direction of the developing roller 5.

The supply compartment 9*a* also has a length greater than the development area width α by a length γ at a downstream end portion of the supply compartment 9*a*. The opening 92 is disposed outside the development area width α in the direction parallel to the axial direction of the developing roller 5.

By contrast, in the developing unit 4 of FIG. 7 according to the present exemplary embodiment, the opening 91 is disposed within the development area width α. Such configuration allows the supply compartment 9 to have a length smaller than the supply compartment 9*a* of the developing unit 4*a* by the length β of the upstream end portion of the supply compartment 9*a* in FIG. 9.

Further, in the developing unit 4 of FIG. 7, the opening 92 is also disposed within the development area width α. Such configuration allows the supply compartment 9 to have a width smaller than the supply compartment 9*a* of the developing unit 4*a* by the length γ of the downstream end portion of the supply compartment 9*a* in FIG. 9.

As such, the developing unit 4 according to the present exemplary embodiment has the opening 91 and the opening 92 both disposed within the development area width α, thereby facilitating downsizing an upper portion of the developing unit 4 compared to the developing unit 4*a* of FIG. 9.

Next, a toner refilling position of the developing unit 4 is described with reference to FIG. 10.

Figure 10:
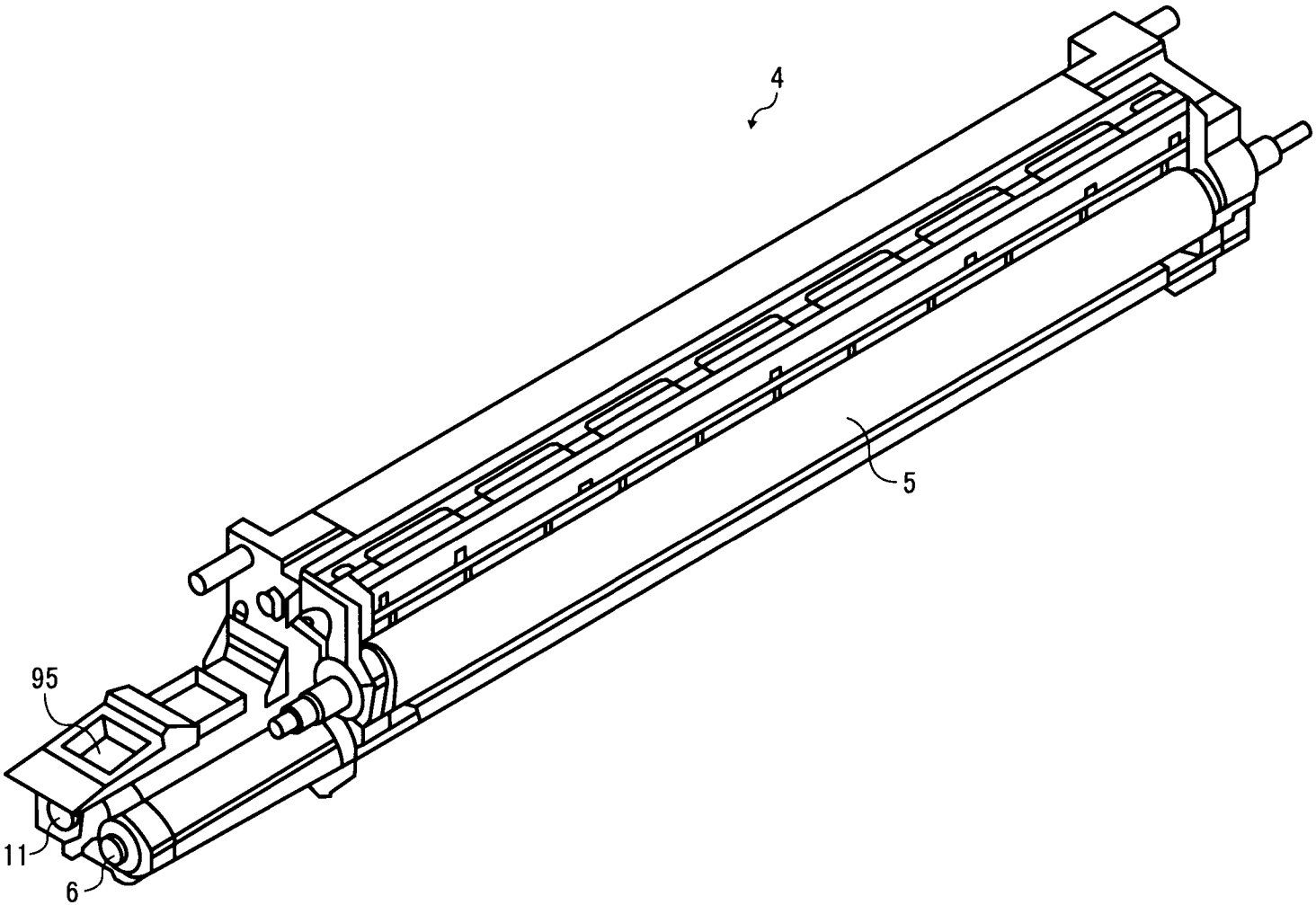
FIG. 10 is a perspective view illustrating the developing unit of FIG. 5.

FIG. 10 is a perspective view illustrating the developing unit 4. As illustrated in FIG. 10, a toner refill port 95 is provided at an upstream end portion of the agitation compartment 10 in its developer transport direction. Through the toner refill port 95, the agitation compartment 10 is refilled with toner. The toner refill port 95 is disposed outside one end portion of the developing roller 5 in its axial direction or outside the development area width α of the developing roller 5.

The toner refill port 95 is provided on a line extending in the developer transport direction of the supply compartment 9 of FIG. 10 and in a space corresponding to the downstream end portion of the supply compartment 9*a* having the length γ in FIG. 9. Further, disposing the opening 92 within the development area width α allows the toner refill port 95 to be provided at such space. Such configuration facilitates downsizing the developing unit 4 compared to the developing unit 4*a* of FIG. 9.

Alternatively, the toner refill port 95 may be provided at a downstream end portion of the recovery compartment 7 instead of the upstream end portion of the agitation compartment 10.

The toner refill port 95 may also be provided over the opening 93, which is disposed between the recovery compartment 7 and agitation compartment 10 to transport developer from the recovery compartment 7 to the agitation compartment 10.

Disposing the opening 92 within the development area width α may also provide a space over the opening 93 in the developing unit 4. Such configuration allows the toner refill port 95 to be provided at such space, thereby facilitating downsizing the developing unit 4 compared to the developing unit 4*a* of FIG. 9. Further, disposing the toner refill port 95 over the opening 93 facilitates mixing of refilled fresh toner with the developer at the opening 93, thereby allowing the developer to be effectively agitated in the agitation compartment 10.

Next, a description is given of a gap Gp between the developing roller 5 and an end portion 133*a* of the separation member 133.

As an initial matter, it is important to note that, if the gap Gp between the developing roller 5 and the end portion 133*a* is too large, a portion of the developer contained in the supply compartment 9 may not be supplied to the developing roller 5 and may instead drop through the gap Gp to the recovery compartment 7 without passing through the development area. Further, if such developer reaches the recovery compartment 7 without being supplied to the developing roller 5, the following types of failures may occur.

Specifically, when the developer dropping through the gap Gp reaches the recovery compartment 7, the amount of developer supplied from the supply compartment 9 may increase, thereby resulting in a reduction of the developer on the downstream side of the supply compartment 9. Such reduction may result in a shortage of developer supplied to the developing roller 5. Such supply shortage may hinder a desired image density from being appropriately provided, thereby resulting in image failures.

Further, as described above, in the case in which a screw is used as the supply transport member of developer in the developing unit 4, if such reduction occurred in the supply compartment 9, the amount of developer supplied to the developing roller 5 might vary according to the screw pitch of the supply screw 8. Such variation in the supply amount of developer might adversely affect the developing process, thereby resulting in image failures such as image unevenness according to the screw pitch of the supply screw 8.

As described above, if the developer dropping through the gap Gp reaches the recovery compartment 7 in addition to the developer supplied from the supply compartment 9 to the developing roller 5, the amount of developer in the recovery compartment 7 may increase. In such a case, the thickness of developer may become greater at the downstream side of the recovery compartment 7 in the developer transport direction thereof, thereby preventing the developer on the developing roller 5 from being appropriately recovered into the recovery compartment 7. Consequently, after passing through the development area, the developer remaining on the surface of the developing roller 5 may reach a facing area at which the developing roller 5 faces the supply compartment 9 and then reach the development area again, which may be called "taking-around phenomenon".

Such developer taken around with rotation of the developing roller 5 may repeatedly pass through a doctor gap or portion and thus be degraded due to friction with the doctor gap. Consequently, such taking-around phenomenon may result in a variation in the degree of degradation of the developer.

By contrast, if the gap Gp between the developing roller 5 and the end portion 133*a* of the separation member 133 is too small, manufacturing errors may bring the developing roller 5 and the end portion 133*a* into contact with each other, resulting in a breakage of the separation member 133 and/or the developing roller 5.

Therefore, the gap Gp between the developing roller 5 and the end portion 133*a* of the separation member 133 needs to be set to an appropriate size.

Experiment 1

Regarding such dropping of developer, the following experiments were conducted.

In the Experiment 1, the developing unit 4 having the configuration illustrated in FIG. 5 was used. The separation member 133 was configured to be replaceable, and a plurality of types of separation members 133 having different positions of respective end portions 133*a* were prepared for the Experiment 1. The plurality of types of separation members 133 were replaced in turn to change the gap Gp between the developing roller 5 and the separation member 133. For each type of separation member 133, the developing unit 4 was driven for ten minutes and then it was determined whether or not developer had dropped through the gap Gp to the recovery compartment 7.

For the determination, an adhesive tape was attached to a wall surface of each separation member 133 on the side of the recovery compartment 7 so that an adhesive face thereof faced up just below the gap Gp. Thus, based on the presence or absence of carrier attached on the adhesive face, it was determined whether or not the dropping of developer had occurred.

One reason that the adhesive tape was disposed so that the adhesive face faced up just below the gap Gp is that, in Experiment 1, the adhesive tape was disposed in the recovery compartment 7. However, if the adhesive tape were disposed in an area in which the developer on the developing roller 5 might attach after passing through the development area, it might not be determined whether or not the developer had dropped through the gap Gp.

Typically, in the developing unit 4, the developer remaining on the developing roller 5 after passing through the development area is separated from the developing roller 5 by action of magnetic poles arranged in a magnet roller of the developing roller 5. At that time, the developer is separated from the developing roller 5 at an area adjacent to an area at which the developing roller 5 faces the recovery screw 6.

If a portion of the developer is not separated from the developing roller 5 at such area and approaches the gap Gp between the developing roller 5 and the end portion 133*a*, such portion of the developer is attracted to the developing roller 5 by certain magnetic poles (hereinafter, attracting poles), which serve to bring up the developer from the supplying compartment 9 to the developing roller 5, and thus does not drop into the recovery compartment 7.

Therefore, if developer is observed on the adhesive face of the adhesive tape disposed just below the gap Gp, it can be determined that the developer had dropped through the gap Gp.

Alternatively, if only toner is observed on the adhesive face, probably, the toner has attached to the adhesive face by being scattered during the developing process rather than by dropping through the gap Gp. Accordingly, based on the presence or absence of carrier attached on the adhesive face, it can be determined whether or not the developer had dropped through the gap Gp.

In Experiment 1, even when a slight amount of carrier was observed on the adhesive face, it was determined that developer had dropped through the gap Gp, which was evaluated as "N.G. (not good)". By contrast, when no carrier was observed on the adhesive face, it was determined that no developer dropped through the gap Gp, which was evaluated as "GOOD".

The conditions of the experiment were set as follows.

The average particle diameter of carrier was set to 35 μm, the average particle diameter of toner was set to 5.0 μm, and the rotation speed of the supply screw 8 was set to 692 rpm.

For the developing roller 5, three rotation patterns were evaluated. In a first pattern, the developing roller 5 was stopped and the supply screw 8 was rotated at 692 rpm. In a second pattern, the developing roller 5 was rotated at a rotation speed of 430 rpm and the supply screw 8 was rotated at 692 rpm. In a third pattern, the developing roller 5 was rotated at a rotation speed of 215 rpm and the supply screw 8 was rotated at 692 rpm.

Further, for the arrangement of magnetic poles of the magnet roller in the developing roller 5, the attracting poles, which bring the developer up from the supply compartment 9, are arranged at an 185-degree angle with respect to a rotation direction in which the developing roller 5 rotates around a line connecting the central axes of the photoconductor 1 and the developing roller 5. Further, the attracting poles were set to have a magnetic flux density of 35.3 mT (millitesla) on the surface of the developing roller 5.

Results of Experiment 1 are illustrated in Table 1.

TABLE 1

| MAGNETIC FLUX DENSITY OF ATTRACTING POLES [mT] | | | 35.3 | | | |
|---|---|---|---|---|---|---|
| GAP WIDTH Gp [mm] | 1.8 | 1.5 | 1.32 | 1.18 | 0.8 | 0.72 |
| DEVELOPING ROLLER NOT ROTATED | N.G. | N.G. | GOOD | GOOD | GOOD | GOOD |
| DEVELOPING ROLLER ROTATED AT 215 rpm | N.G. | N.G. | GOOD | GOOD | GOOD | GOOD |
| DEVELOPING ROLLER ROTATED AT 430 rpm | N.G. | N.G. | GOOD | GOOD | GOOD | GOOD |

As illustrated in Table 1, for the gap Gp of 1.8 mm or 1.5 mm, the dropping of developer through the gap Gp was observed, as indicated by "N.G.". By contrast, for the gap Gp of 1.32 mm or less, such dropping of developer through the gap Gp was not observed as indicated by "GOOD".

The results of the Experiment 1 illustrated in Table. 1 suggest that it is preferable that the gap Gp between the developing roller 5 and the end portion 133*a* be set to 1.4 mm or less.

On the other hand, as described above, if the gap Gp between the developing roller 5 and the end portion 133*a* is set to 0 mm, the developing roller 5 and the end portion 133*a* may be brought into contact and thus be damaged. Accordingly, the gap Gp should be more than 0 mm.

Alternatively, if the gap Gp is too small, an accumulation of errors in manufacturing various components may bring the developing roller 5 and the separation member 133 into unintended contact with each other. On the other hand, a gap Gp of 0.2 mm or greater can prevent the developing roller 5 and the separation member 133 from contacting with each other.

Accordingly, setting the gap Gp between the developing roller 5 and the separation member 133 to a width of 0.2 mm or greater and 1.4 mm or less can prevent damages due to a contact between the developing roller 5 and the separation member 133 while suppressing failures due to the dropping of developer through the gap Gp.

As described above, the average particle diameter of carrier was set to 35 μm in the Experiment 1. Generally, the greater the average particle diameter of carrier, the carrier becomes heavier and thus more easily drops through the gap Gp.

Therefore, when using career having an average particle diameter of 35 μm or less, setting the gap Gp between the developing roller 5 and the end portion 133*a* to 1.4 mm or less can prevent developer from dropping through the gap Gp.

In Experiment 1, the magnetic flux density at the gap Gp on the surface of the developing roller 5 was from 1.0 mT to 2.0 mT, which indicates a variation generated in the axial direction of the developing roller 5.

As described above, a portion of the developer passed through the development area may remain on the developing roller 5 without dropping into the recovery compartment 7. To prevent such taking-around phenomenon, it is preferable that the magnetic flux density at the gap Gp be set to 3 mT or less. However, if the magnetic flux density at the gap Gp is too small, the developer may be more likely to drop through the gap Gp into the recovery compartment 7.

In this regard, the results of Experiment 1 suggest that, with the magnetic flux density of 3 mT, setting the gap Gp between the developing roller 5 and the end portion 133*a* to 1.4 mm or less and the magnetic flux density to 1.0 mT or greater can prevent the developer from dropping through the gap Gp.

In Experiment 1, setting the gap Gp to 1.4 mm or less produced the "GOOD" results as illustrated in Table 1.

However, even if the same conditions as those of Experiment 1 are set in a real apparatus, a certain degree of variation may occur due to manufacturing errors. Accordingly, to securely prevent the developer from dropping through the gap Gp, preferably, the gap Gp is set to 0.8 mm or less.

As described above, the developing unit 4 according to the present exemplary embodiment has the gap Gp of 0.7 mm, thereby securely preventing the developer from dropping through the gap Gp.

Experiment 2

Next, a second experiment was conducted in a manner similar to Experiment 1 although the magnetic flux density of the attracting poles was changed while the width of the gap Gp was fixed at 1.32 mm.

Table 2 illustrates results of Experiment 2. The magnetic flux densities described in Table 2 are the values on the surface of the developing roller 5.

TABLE 2

| | | | | | | | |
|---|---|---|---|---|---|---|---|
| MAGNETIC FLUX DENSITY OF ATTRACTING POLES [mT] | 29.2 | 32.1 | 34.1 | 35.3 | 40.6 | 44.9 | 45.6 |
| GAP WIDTH Gp [mm] | | | | 1.32 | | | |
| DEVELOPING ROLLER NOT ROTATED | N.G. | N.G. | N.G. | GOOD | GOOD | GOOD | GOOD |
| DEVELOPING ROLLER ROTATED AT 215 rpm | N.G. | N.G. | N.G. | GOOD | GOOD | GOOD | GOOD |
| DEVELOPING ROLLER ROTATED AT 430 rpm | N.G. | N.G. | N.G. | GOOD | GOOD | GOOD | GOOD |

As illustrated in Table 2, when the magnetic flux density was set to 34.1 mT, the dropping of developer from the gap Gp was observed and thus was evaluated as "NG".

On the other hand, when the magnetic flux density was set to 35.3 mT or greater, the dropping of developer through the gap Gp was not observed and thus was evaluated as "GOOD".

The results of Experiment 2 suggest that, in order to prevent the developer from dropping through the gap Gp, preferably, the magnetic flux density of attracting poles is set to 35 mT or greater.

The developing unit 4 according to the present exemplary embodiment may also be operable with a toner having a relatively low melting point, for example, a glass-transition temperature of 35° C. or greater and 55° C. or less.

Next, a description is given of such a toner having a low melting point.

In electrophotographic methods, generally heat roller systems are used as fixing systems because of high energy efficiency. Regarding such heat roller systems, recently, there has been an increasing demand to fix toner at a relatively low temperature for energy saving. Particularly, such demand has been increasing in high-speed image forming apparatuses with high energy consumption.

Accordingly, various attempts have been made to save heat energy applied to toner for fixing. Above all, there is a strong demand for reducing a waiting time to minimize the consumption amount of electricity. Such waiting time includes, for example, a warm-up time from when an image forming apparatus is activated to when the image forming apparatus is brought into a state capable of starting image formation.

Further, the 1999 demand-side management (DSM) program of the International Energy Agency (IEA) includes a technological procurement project for next-generation copiers. In its published specification requirements, for example, copiers having a copying speed of 20 cpm (copies per minute) or greater are required to achieve dramatic energy savings compared to conventional copiers.

One way to achieve such requirements is to reduce the heat capacity of a fixing member such as a heat roller, thereby enhancing temperature response of toner. However, such method may not achieve sufficient energy saving. As a result, to achieve such requirements and minimize the waiting time, it may be needed to reduce the fixing temperature of toner.

Further, recently, there have been increasing demands for high-quality images. For example, a conventional toner having an average particle diameter of 10 μm to 15 μm may be unable to meet such demands, thereby leading to a demand for further reduction in the particle diameter of toner.

However, such reduction in the particle diameter of toner may result in various failures except a failure in image quality. Particularly, in the fixing process, the amount of toner attached to a fixed member such as a paper sheet may decrease in halftone areas, thereby significantly reducing the amount of heat that a heating member applies to the toner transferred onto recess portions of the fixed member. Consequently, such reduction in the particle diameter of toner may result in offset phenomenon or other failures.

Accordingly, a toner containing a releasing agent such as wax is generally used to prevent such offset phenomenon. In such case, the releasing agent may be configured to exude from toner particles during the fixing process.

However, such inclusion of releasing agent into toner or reduction in the fixing temperature of toner may result in such failures as a reduction in the heat stability of toner or an increase in the vulnerability of toner to various stress.

Particularly, when using a two-component developer containing toner and carrier, agitation in the developing unit or conflict with a metal member in forming a development magnet brush at a uniform thickness may cause stress on the developer, thereby resulting in failures such as fusion or aggregation of toner particles. Such failures may also be notably observed when using a binding resin, such as polyester, enabling lower temperature fixation.

Recently, proposals have been made to prescribe a toner containing a binding resin, such as polyester, to obtain a preferable low-temperature fixing performance and heat stability by a component insoluble to tetrahydrofuran (THF) or chloroform.

However, certain types of organic solvent such as crystalline polyester serve as binding resin having a relatively high fixing performance at low temperature while almost insoluble. Solubility varies according to the type of organic solvent. Accordingly, it may be difficult to prescribe a toner capable of simultaneously satisfying high fixing performance at low temperature, heat stability, and stress stability as described above with a component insoluble to a single type of organic solvent.

Next, such difficulty is described below with reference to a conventional developing unit.

FIG. 1 illustrates a schematic view illustrating a conventional developing unit 104. The conventional developing unit 104 of FIG. 1 has a supply recovery compartment 402 that supplies developer to a developing roller 5 and a separate agitation compartment 10 that agitates the developer. The supply compartment 402 and the agitation compartment 10 transport developer in opposite directions to circulate the developer in the conventional developing unit 104.

In the conventional developing unit 104 of FIG. 1, the supply recovery compartment 402 performs both functions of supplying developer to the developing roller 5 and recovering the developer passed through a development area. As a result, immediately after the developer passing through the development area is recovered in the supply recovery compartment 402, the recovered developer may be supplied to the developing roller 5, resulting in a variation in the number of times that such developer passes through a doctor gap or portion 5*a*.

The doctor portion 5*a* may apply relatively great stress on the developer, and consequently an increase in the number of passing through the doctor portion 5*a* may degrade the developer. Further, the developer is heated by friction at the doctor portion 5*a*, and consequently repetitive passages through the doctor portion 5*a* may rise the temperature of developer.

Figure 11:
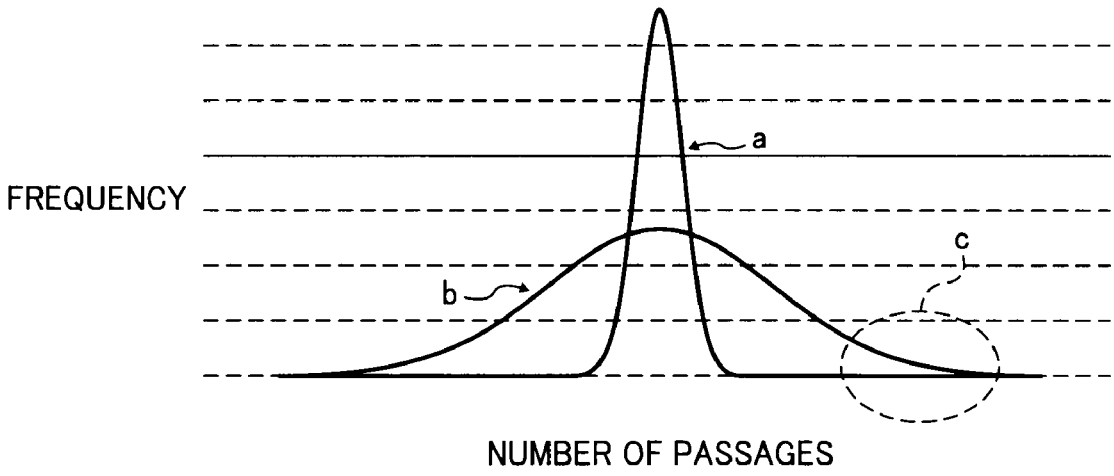
FIG. 11 is a graph schematically illustrating relationships between the number of times that developer passes through a doctor portion and the frequency of developer according to the number of passage times.

FIG. 11 is a graph schematically illustrating relationships between the number of passing through the doctor portion 5*a* and the frequency of developer according to the number of passages.

In FIG. 11, a curve "a" indicates a relatively small variance in the number of times that developer passes through the doctor portion 5*a*, while a curve "b" indicates a relatively large variance in the number of times.

When using a low-temperature fixable toner having a low melting point, a portion of developer included in a dashed circle area "c", for example, may be more significantly degraded, thereby resulting in such failures as fusion and aggregation of toner particles. Further, such failures may result in image failures such as white bands on a resultant image.

In the conventional developing unit 104 of FIG. 1, just after being recovered from the developing roller 5, the developer may be supplied to the developing roller 5. Consequently, a variation may occur in the number of times that the developer passes through the doctor portion 5*a*, thereby increasing the frequency of developer included in the area "c". Accordingly, when a low-temperature fixable toner is used in the conventional developing unit 104 illustrated in FIG. 1, fusion and aggregation of toner particles may occur, and therefore the conventional developing unit 104 may be disadvantageous to the use of a low-temperature fixable toner.

Figure 2:
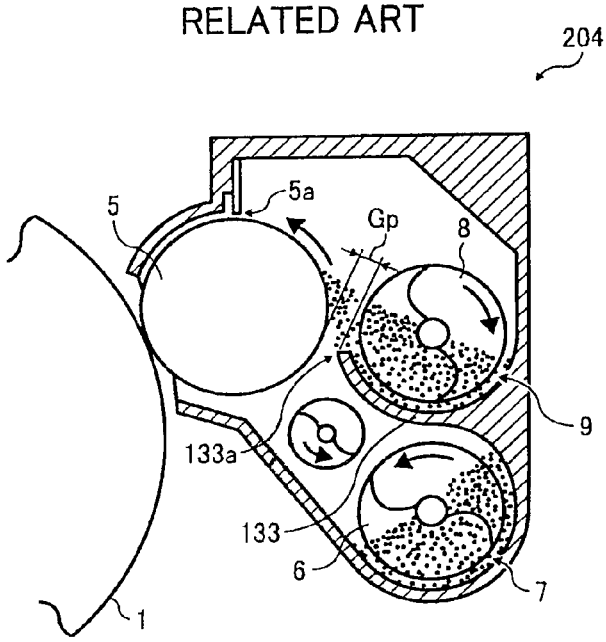
FIG. 2 RELATED ART
FIG. 2 is a schematic view illustrating another conventional developing unit.
Figure 3:
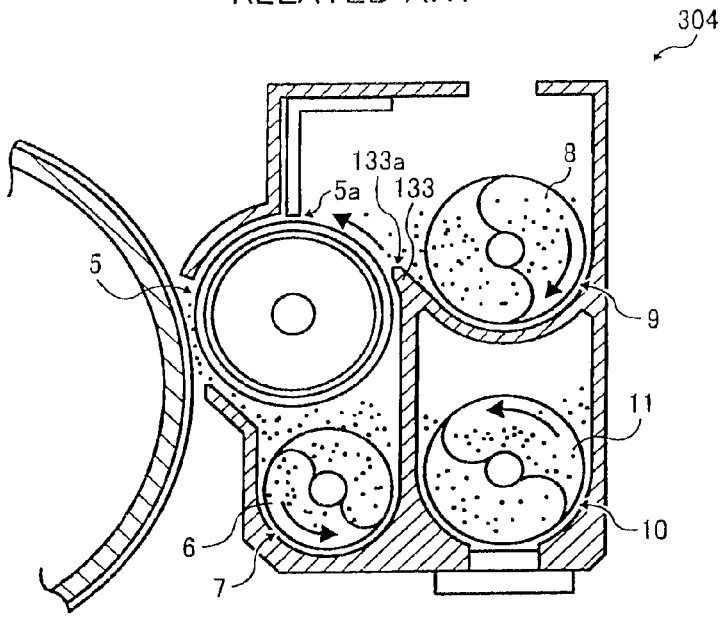
FIG. 3 RELATED ART
FIG. 3 is a schematic view illustrating still another conventional developing unit.

Such failures, caused by supplying developer to the developing roller 5 just after the recovery process may be prevented by using a conventional developing unit illustrated in FIG. 2 or 3.

For example, a conventional developing unit 204 of FIG. 2 has a supply compartment 9 that supplies developer to the developing roller 5 and a separate recovery compartment 7 that recovers the developer passed through a development area. In the developing unit 204 thus configured, the developer passed through the development area is transported to the recovery compartment 7 without being mixed into the supply compartment 9. Such configuration can prevent the developer recovered from the developing roller 5 from being supplied to the developing roller 5 again just after the recovery, thereby suppressing a variance in the number of times that such developer passes through the doctor portion 5*a*.

Similarly, a conventional developing unit 304 of FIG. 3 has a supply compartment 9 that supplies developer to the developing roller 5 and a separate recovery compartment 7 that recovers the developer passed through a development area.

The conventional developing unit 304 also has an agitation compartment 10 that transports the developer in a direction opposite a direction in which the supply compartment 9 transports the developer transported to a downstream end portion of the supply compartment 9 and the recovered developer transported to a downstream end portion of the recovery compartment 7 while agitating the developer and the recovered developer.

In the developing unit 304 thus configured, the developer passed through the development area is transported to the recovery compartment 7 without being mixed into the supply compartment 9. Such configuration can prevent the developer recovered from the developing roller 5 from being supplied to the developing roller 5 again just after the recovery, thereby suppressing a variance in the number of times that such developer passes through the doctor portion 5*a*.

Further, the conventional developing unit 304 supplies the recovered developer to the supply compartment 9 after agitating the recovered developer in the agitation compartment 10 rather than supplying the recovered developer to the supply compartment 9 just after the recovery.

Such configuration allows the recovered developer to be supplied to the supply compartment 9 in a well-agitated state. Further, such configuration may provide a sufficient period of time from when the developer passes through the development area to when the developer reaches the development area again. Such period of time may allow the developer to pass through the doctor portion 5*a* at a relatively long interval, thereby releasing heat from the developer.

However, even when the conventional developing unit 304 of FIG. 3 is used, a portion of the developer passed through the development area may be lifted up and taken around along with rotation of the developing roller 5. Such portion of developer is caused to repeatedly pass through the doctor portion 5*a*, thereby resulting in fusion and aggregation of toner particles. Consequently, an image failure, reduction in the service life of developer, or other failures may occur.

Such "taking-around" phenomenon may be caused in the developing unit 304 of FIG. 3 in the following manner, for example.

If a gap Gp between the developing roller 5 and an end portion 133*a* of a separation member 133 is too great, some of developer may drop into the recovery compartment 7 in addition to the developer supplied from the supply compartment 9 to the developing roller 5.

Consequently, the amount of developer in the recovery compartment 7 increases by the amount of developer dropped through the gap Gp. Such increase may increase the height of developer on a downstream side of the recovery compartment 7 in the developer transport direction thereof, thereby preventing the developer on the surface of the developing roller 5 from dropping into the recovery compartment 7. If such preventing occurs, the developer passed through the development area may remain on the developing roller 5, pass through a portion at which the developing roller 5 faces the supply compartment 9, and is taken around to the development area again.

Further, if the height of developer in the recovery compartment 7 further increases, the developer recovered from the developing roller 5 to the recovery compartment 7 may be attached to the developing roller 5 again. Such re-attachment of developer may cause the developer recovered from the developing roller 5 to be supplied to the developing roller 5 again just after the recovery, thereby generating a variance in the number of times that developer passes through the doctor portion 5*a*. Consequently, when using a low-temperature fixable toner, fusion and aggregation of toner particles may occur.

Regarding such failures, in the developing unit 4 of FIG. 5 according to the present exemplary embodiment, the gap Gp between the developing roller 5 and the end portion 133*a* is set to 1.4 mm or less to prevent developer from dropping through the gap Gp. As a result, an increase in the height of developer can be suppressed on a downstream portion of the recovery compartment 7 in the developer transport direction thereof, thereby preventing such "taking-around" phenomenon of developer passed through the development area and/or re-attachment of developer once recovered to the recovery compartment 7. Thus, a variance may be prevented from occurring in the number of times that developer passes through the doctor portion 5*a*, thereby preventing a portion of developer from being repeatedly heated by a friction at the doctor portion 5*a*.

Accordingly, even when a low-temperature fixable toner is used as a toner component of the two-component developer, the developing unit 4 of FIG. 5 is capable of preventing fusion and aggregation of toner particles. As a result, preferable image quality can be maintained while reducing the amount of energy consumed in an image forming operation.

As such low-temperature fixable toner, for example, a toner having a glass-transition temperature of 40° C. degrees or greater and 50° C. or less may be used in the developing unit 4.

Variation Example

In the above-described exemplary embodiment, the developing unit 4 of FIG. 5 has three developer compartments: the supply compartment 9, the recovery compartment 7, and the agitation compartment 10.

It should be noted that the above-described configuration in which the gap Gp between the developing roller 5 and the end portion 133*a* is set to an appropriate size is applicable to the developing unit 204 of FIG. 2 having two developer compartments, that is, the supply compartment 9 and the recovery compartment 7.

Below, such a configuration in which the gap Gp between the developing roller 5 and the end portion 133*a* is set to an appropriate size in the developing unit 204 of FIG. 2 is described as one variation example of the above-described exemplary embodiment.

In the present variation example, a developing unit 4 has a configuration basically similar to the configuration of FIG. 2 except that the screw diameter, screw pitch, and rotation speed of a supply screw 8 is set 22 mm, 25 mm, and 692 rpm, respectively. Further, in the developing unit 4, the diameter and rotation speed of a developing roller 5 is set to 25 mm and 430 rpm, respectively. Two-component developer includes carrier having an average particle diameter of 35 μm and toner having an average particle diameter of 5.0 μm.

In the developing unit 4, the gap Gp between the developing roller 5 and the separation member 133 is set to a value of 0.2 mm or greater and 1.4 mm or less. Similar to the above-described exemplary embodiment, such configuration can prevent the developing roller 5 and the separation member 133 from contacting with each other and being thus damaged. Such configuration can also prevent failures that otherwise might be caused by the dropping of developer through the gap Gp.

In the developing unit 4, the developer transported to a recovery compartment 7 is immediately supplied to a supply compartment 9. As a result, even if toner is refilled to maintain the developer at an appropriate concentration, the developer may not be sufficiently agitated, thereby resulting in an unevenness or reduction in image density during the developing process. Such unevenness or reduction in image density may be notably observed in an image having a relatively high print ratio, resulting in a decrease in toner density of the developer recovered from the developing roller 5.

On the other hand, the developing unit 4 of FIG. 5 according to the above-described exemplary embodiment agitates the developer recovered from the developing roller 5 and then supplies the agitated developer to the supply compartment 9 rather than immediately supplying the recovered developer to the supply compartment 9. Accordingly, the sufficiently-agitated developer can be supplied to the supply compartment 9, thereby more effectively preventing an unevenness or reduction in image density during the developing process compared to the developing unit 4.

Further, in the developing unit 4, the developer transported to the recovery compartment 7 is immediately supplied to the supply compartment 9. Consequently, the developer may be supplied to the supply compartment 9 again without being sufficiently cooled down. If the number of sheets to be continuously printed is small or a continuous drive time of the developing unit 4 is not so long, generally such insufficient cooling does not significantly matter.

By contrast, if the number of sheets to be continuously printed is relatively great, such failures as fusion or aggregation of toner particles may occur. In particular, such failures may be observed more notably when the developing unit 4 transports developer at high speed or when an image having a low print ratio is printed.

Alternatively, a portion of developer passed through the development area may be drawn up and taken around with rotation of the developing roller 5. The greater the rotation speed and/or diameter of the developing roller 5, the amount of such taken-around developer may increase, which may be particularly notably observed when the developing unit 4 transports the developer at relatively high speed.

On the other hand, the developing unit 4 of FIG. 5 agitates developer in the agitation compartment 10 before supplying the developer to the supply compartment 9. Thus, while agitating the developer in the agitation compartment 10, the developing unit 4 can cool down the toner contained in the developer, whose temperature is increased by friction at the doctor portion 5*a*. As a result, even when conducting a continuous printing operation for a relatively great number of sheets, the developing unit 4 can prevent failures such as fusion and aggregation of toner particles.

As described above, according to the present example embodiment, the developing unit 4 has the developing roller 5, the supply compartment 9, the recovery compartment 7, and the separation member 133.

The developing roller 5 serves as a developer carrier that rotates while carrying two-component developer containing toner and magnetic carrier on its surface and supplies the toner to a latent image carried on the surface of the photoconductor 1 in a development area facing the photoconductor 1 serving as a latent image carrier to develop the latent image. The supply compartment 9 has the supply screw 8 serving as a supply transport member that transports the developer in an axial direction of the developing roller 5 and supplies the developer to the developing roller 5. The recovery compartment 7 has the recovery screw 6 serving as a recovery transport member that transports the developer, recovered from the surface of the developing roller 5 after passing through the development area facing the photoconductor 1, in the axial direction of the developing roller 5. The recovery compartment 7 and the supply compartment 9 are separated by the separation member 133 having the end portion 133*a* that faces the surface of the developing roller 5 and is disposed perpendicular to the axial direction of the developing roller 5. The supply compartment 9 is disposed above the recovery compartment 7 behind the separation member 133.

In the developing unit 4, the gap Gp between the end portion 133*a* and the developing roller 5 is set to 1.4 mm or less, thereby preventing failures that otherwise might be caused by the developer dropped from the gap Gp.

Alternatively, the gap Gp between the end portion 133*a* and the developing roller 5 may be set to 0.8 mm or less to more securely prevent the developer from dropping through the gap Gp.

The developing roller 5 serving as the developer carrier includes a magnetic roller that arranges magnetic poles in a certain pattern. Out of the magnetic poles, the magnetic flux density of attracting poles on the surface of the developing roller 5 is set to 35 mt or greater, thereby more securely preventing the developer from dropping through the gap Gp.

Further, the developing unit 4 may employ a low-temperature fixable toner having a low melting point, for example, a glass-transition temperature of 35° C. or greater and 55° C. or less, thereby maintaining excellent image quality while saving the amount of energy consumed for image formation.

Further, as illustrated in FIG. 6, the recovery screw 6 may transport the developer in the direction parallel to the direction in which the supply screw 8 transports the developer.

The developing unit 4 may also have the agitation compartment 10 with the agitation screw 11. The agitation compartment 10 receives the excess developer, which is transported to the downstream end portion of the supply compartment 9, and the recovered developer, which is recovered from the developing roller 5 and transported to the downstream end portion of the recovery compartment 7. The agitation compartment 10 also uses the agitation screw 11, serving as an agitation transport member, to agitate and transport the excess developer and recovered developer as agitated developer in a direction opposite the direction in which the supply screw 8 transports developer. Thus, the agitation compartment 10 supplies the agitated developer to the supply compartment 9.

Regarding the three developer compartments including the recovery compartment 7, the supply compartment 9, and the agitation compartment 10, the developing unit 4 may have the first separation wall 135 separating the supply compartment 9 and the agitation compartment 10 and the second separation wall 134 separating the recovery compartment 7 and the agitation compartment 10. Such configuration allows the recovery and agitation of developer to be conducted in separate compartments, thereby preventing the developer passed through the development area from dropping during agitation. Accordingly, the developer can be supplied in a sufficiently agitated state to the supply compartment 9.

Thus, the developing unit 4 can prevent a reduction in the toner concentration and insufficient agitation of the developer in the supply compartment 9, thereby stabilizing an image density during a developing process.

Further, as illustrated in FIG. 5, the agitation compartment 10 and the recovery compartment 7 may be disposed at substantially identical heights, and the supply compartment 9 may be disposed above the agitation compartment 10 and the recovery compartment 7. Such configuration can reduce stress on the developer and save a space in a horizontal direction of the developing unit 4.

Further, as illustrated in FIG. 5, the supply compartment 9 may be disposed obliquely above the agitation compartment 10. Such configuration can further reduce stress on the developer compared to the configuration in which the supply compartment 9 is disposed vertically above the agitation compartment 10.

Alternatively, as illustrated in FIGS. 7 and 8, the opening 91 serving as an opening in the first separation wall 135 connecting the upstream end portion of the supply compartment 9 and the downstream end portion of the agitation compartment 10 may be disposed between both end portions of the developing roller 5 in the axial direction thereof. Such configuration can save a space in an upper portion of the developing unit 4.

Further, as illustrated in FIGS. 7 and 8, the opening 92 serving as an opening in the first separation wall 135 connecting the downstream end portion of the supply compartment 9 and the upstream end portion of the agitation compartment 10 may be disposed between both end portions of the developing roller 5 in the axial direction thereof. Such configuration can also save a space in an upper portion of the developing unit 4.

The agitation transport member may be the agitation screw 11 that is disposed parallel to the axial direction of the developing roller 5 and formed in a spiral shape. Such configuration allows the developer to be agitated in the agitation compartment 10 and supplied to the supply compartment 9.

The supply transport member and recovery transport member may be the supply screw 8 and recovery screw 6, respectively, that are disposed parallel to the axial direction of the developing roller 5 and formed in spiral shapes. With such screws, the developing unit 4 can transport the developer in the supply compartment 9 while supplying the developer to the developing roller 5, and can transport the developer recovered from the developing roller 5 to the recovery compartment 7.

Further, as described above, the image forming apparatus 500 has the photoconductor 1 serving as a latent image carrier, the charger serving as a charger to charge a surface of the photoconductor 1, the optical writing unit 21 serving as a latent image forming unit to form an electrostatic latent image on the photoconductor 1, and the developing unit 4 according to the above-described exemplary embodiment serving as a developing unit 4 to develop the electrostatic latent image into a toner image. Such configuration can prevent shortage of the developer supplied to the developing roller 5 and fusion and aggregation of toner particles, thereby stably performing image formation.

Further, the image forming apparatus 500 may have the process cartridge 18 detachably mountable to the image forming apparatus 500. In the process cartridge 18, at least the photoconductor 1 and the developing unit 4 may be held by a single holder to form an integrated unit. Such configuration allows the developing unit 4 and the photoconductor 1 to be easily replaced with new ones.

In the above-described method of forming an image, the developing unit 4 according to the above-described exemplary embodiment is used to develop a latent image on the photoconductor 1. Such method can prevent shortage of the developer supplied to the developing roller 5 and fusion and aggregation of toner particles, thereby providing a stable image forming operation.

Further, as in the above-described variation example, the developing unit 4 may have two developer compartments, that is, the supply compartment 9 and the recovery compartment 7 as illustrated in FIG. 2. In such configuration, the recovery compartment 7 uses the recovery screw 6, serving as a recovery transport member, to transport the developer in the direction opposite the direction in which the supply screw 8 transports the developer, and to supply the developer, transported to the downstream end portion of the recovery compartment 7, to the supply compartment 9. Further, setting the gap Gp between the end portion 133*a* and the developing roller 5 to 1.4 mm or less can prevent the developer from dropping through the gap Gp, thereby preventing failures that otherwise might be caused by the dropping of developer.

Examples and embodiments being thus described, it should be apparent to one skilled in the art after reading this disclosure that the examples and embodiments may be varied in many ways. Such variations are not to be regarded as a departure from the spirit and scope of the present invention, and such modifications are not excluded from the scope of the following claims.

What is claimed is:

1. A developing unit used in an image forming apparatus having a latent image carrier, the latent image carrier having a surface to carry a latent image thereon, the developing unit comprising:

a developer carrier disposed to face the latent image carrier and configured to rotate while carrying two-component developer containing toner and magnetic carrier and to supply the toner to the latent image, carried on the surface of the latent image carrier, in a development area in which the developer carrier faces the latent image carrier;

a supply compartment comprising a supply transport member configured to transport the developer in a first direction parallel to an axial direction of the developer carrier and to supply the developer to the developer carrier;

a recovery compartment comprising a recovery transport member configured to transport the developer, recovered from the developer carrier after passing through the development area, in a second direction parallel to the axial direction of the developer carrier;

a separation member comprising one end portion disposed to face the developer carrier at a facing area, the separation member disposed to separate the supply compartment and the recovery compartment, the supply compartment disposed above the recovery compartment behind the separation member; and a gap provided at the facing area at which the one end portion of the separation member faces the developer carrier, an agitation compartment with an agitation transport member, wherein the agitation compartment receives excess developer of the developer, transported to a downstream end portion of the supply compartment in the first direction in which the supply transport member transports the developer, and recovered developer of the developer, recovered from the developer carrier and transported to a downstream end portion of the recovery compartment in the second direction in which the recovery transport member transports the developer, and supplies agitated developer to the supply compartment by the agitation transport member that, while agitating the excess developer and the recovered developer into the agitated developer, transports the agitated developer in a direction opposite the first direction in which the supply transport member transports the developer;

a first separation wall configured to separate the supply compartment and the agitation compartment; and a second separation wall configured to separate the recovery compartment and the agitation compartment, wherein the second direction in which the recovery compartment transports the developer is the same as the first direction in which the supply transport member transports the developer.

2. The developing unit according to claim 1, wherein the gap has a width of not more than 1.4 millimeters.

3. The developing unit according to claim 1, wherein the gap has a width of not more than 0.8 millimeters.

4. The developing unit according to claim 1, wherein the developer carrier has magnetic poles arranged in a certain pattern, and, out of the magnetic poles, magnetic poles attracting the developer from the supply compartment to the developer carrier have a magnetic flux density of more than 35 millitesla.

5. The developing unit according to claim 1, wherein the toner included in the developer has a glass-transition temperature of 35° C. or more and 55° C. or less.

6. The developing unit according to claim 1, wherein the agitation compartment and the recovery compartment are disposed at substantially identical heights and the supply compartment is disposed above the agitation compartment and the recovery compartment.

7. The developing unit according to claim 1, wherein the supply compartment is disposed obliquely above the agitation compartment.

8. The developing unit according to claim 1, wherein the first separation wall has a first opening connecting the upstream end portion of the supply compartment and the downstream end portion of the agitation compartment, and wherein the first opening is disposed at a position between both end portions of the developer carrier in the axial direction of the developer carrier.

9. The developing unit according to claim 1, wherein the first separation wall has a second opening connecting the downstream end portion of the supply compartment and the upstream end portion of the agitation compartment, and wherein the second opening is disposed at a position between both end portions of the developer carrier in the axial direction of the developer carrier.

10. The developing unit according to claim 1, wherein the agitation transport member is a spiral screw disposed parallel to the developer carrier.

11. The developing unit according to claim 1, wherein the recovery transport member transports the developer in a direction opposite the first direction in which the supply transport member transports the developer, and supplies the developer, transported to a downstream end portion of the recovery compartment, to the supply compartment.

12. The developing unit according to claim 1, wherein the supply transport member and the recovery transport member are spiral screws disposed parallel to the developer carrier.

13. An image forming apparatus, comprising:

a latent image carrier having a surface to carry a latent image;

a charger configured to charge the surface of the latent image carrier;

a latent image forming unit configured to form the latent image on the latent image carrier; and a developing unit configured to develop the latent image formed on the latent image carrier into a toner image, the developing unit comprising:

a developer carrier disposed to face the latent image carrier and configured to rotate while carrying two-component developer containing toner and magnetic carrier and to supply the toner to the latent image, carried on the surface of the latent image carrier, in a development area in which the developer carrier faces the latent image carrier;

a supply compartment comprising a supply transport member configured to transport the developer in a first direction parallel to an axial direction of the developer carrier and to supply the developer to the developer carrier;

a recovery compartment comprising a recovery transport member configured to transport the developer, recovered from the developer carrier after passing through the development area, in a second direction parallel to the axial direction of the developer carrier;

a separation member comprising one end portion disposed to face the developer carrier at a facing area, the separation member disposed to separate the supply compartment and the recovery compartment, the supply compartment disposed above the recovery compartment behind the separation member; and a gap provided at the facing area at which the one end portion of the separation member faces the developer carrier, an agitation compartment with an agitation transport member, wherein the agitation compartment receives excess developer of the developer, transported to a downstream end portion of the supply compartment in the first direction in which the supply transport member transports the developer, and recovered developer of the developer, recovered from the developer carrier and transported to a downstream end portion of the recovery compartment in the second direction in which the recovery transport member transports the developer, and supplies agitated developer to the supply compartment by the agitation transport member that, while agitating the excess developer and the recovered developer into the agitated developer, transports the agitated developer in a direction opposite the first direction in which the supply transport member transports the developer;

a first separation wall configured to separate the supply compartment and the agitation compartment; and a second separation wall configured to separate the recovery compartment and the agitation compartment, wherein the second direction in which the recovery compartment transports the developer is the same as the first direction in which the supply transport member transports the developer.

14. A process cartridge detachably mountable in an image forming apparatus, the process cartridge comprising:

a latent image carrier having a surface to carry a latent image;

a developing unit configured to develop the latent image on the latent image carrier into a toner image; and a holder configured to hold the latent image carrier and the developing device together as one unit, the developing unit comprising:

a developer carrier disposed to face the latent image carrier and configured to rotate while carrying two-component developer containing toner and magnetic carrier and to supply the toner to the latent image, carried on the surface of the latent image carrier, in a development area in which the developer carrier faces the latent image carrier;

a supply compartment comprising a supply transport member configured to transport the developer in a first direction parallel to an axial direction of the developer carrier and to supply the developer to the developer carrier;

a recovery compartment comprising a recovery transport member configured to transport the developer, recovered from the developer carrier after passing through the development area, in a second direction parallel to the axial direction of the developer carrier;

a separation member comprising one end portion disposed to face the developer carrier at a facing area, the separation member disposed to separate the supply compartment and the recovery compartment, the supply compartment disposed above the recovery compartment behind the separation member; and a gap provided at the facing area at which the one end portion of the separation member faces the developer carrier, an agitation compartment with an agitation transport member, wherein the agitation compartment receives excess developer of the developer, transported to a downstream end portion of the supply compartment in the first direction in which the supply transport member transports the developer, and recovered developer of the developer, recovered from the developer carrier and transported to a downstream end portion of the recovery compartment in the second direction in which the recovery transport member transports the developer, and supplies agitated developer to the supply compartment by the agitation transport member that, while agitating the excess developer and the recovered developer into the agitated developer, transports the agitated developer in a direction opposite the first direction in which the supply transport member transports the developer;

a first separation wall configured to separate the supply compartment and the agitation compartment; and a second separation wall configured to separate the recovery compartment and the agitation compartment, wherein the second direction in which the recovery compartment transports the developer is the same as the first direction in which the supply transport member transports the developer.

15. The process cartridge according to claim 14, wherein the gap has a width of not more than 1.4 millimeters.

16. The process cartridge according to claim 14, wherein the gap has a width of not more than 0.8 millimeters.

17. The process cartridge according to claim 14, wherein the developer carrier has magnetic poles arranged in a certain pattern, and, out of the magnetic poles, magnetic poles attracting the developer from the supply compartment to the developer carrier have a magnetic flux density of more than 35 millitesla.

18. The process cartridge according to claim 14, wherein the agitation compartment and the recovery compartment are disposed at substantially identical heights, and the supply compartment is disposed above the agitation compartment and the recovery compartment.

* * * * *